US011454002B2

(12) United States Patent
Takahashi et al.

(10) Patent No.: US 11,454,002 B2
(45) Date of Patent: Sep. 27, 2022

(54) HYDRAULIC DRIVE SYSTEM FOR WORK MACHINE

(71) Applicant: Hitachi Construction Machinery Tierra Co., Ltd., Koka (JP)

(72) Inventors: Kiwamu Takahashi, Moriyama (JP); Taihei Maehara, Koka (JP); Takeshi Ishii, Hino-cho (JP)

(73) Assignee: Hitachi Construction Machinery Tierra Co., Ltd., Koka (JP)

( * ) Notice: Subject to any disclaimer, the term of this patent is extended or adjusted under 35 U.S.C. 154(b) by 728 days.

(21) Appl. No.: 16/331,768

(22) PCT Filed: Sep. 29, 2017

(86) PCT No.: PCT/JP2017/035671

§ 371 (c)(1),
(2) Date: Mar. 8, 2019

(87) PCT Pub. No.: WO2019/064555

PCT Pub. Date: Apr. 4, 2019

(65) Prior Publication Data

US 2021/0340720 A1 Nov. 4, 2021

(51) Int. Cl.
*E02F 9/22* (2006.01)

(52) U.S. Cl.
CPC ..... *E02F 9/2221* (2013.01); *E02F 9/2217* (2013.01); *E02F 9/2267* (2013.01); *E02F 9/2271* (2013.01)

(58) Field of Classification Search
CPC ..... E02F 9/2217; E02F 9/2207; F15B 21/14; F15B 2211/88
See application file for complete search history.

(56) References Cited

U.S. PATENT DOCUMENTS 10,184,228 B2 * 1/2019 Ito ..... E02F 9/22
10,669,695 B2 * 6/2020 Ito ..... E02F 9/2225
(Continued)

FOREIGN PATENT DOCUMENTS

JP 2007-170485 A 7/2007
JP 2008-185182 A 8/2008
(Continued)

OTHER PUBLICATIONS

JP 2007170485 A machine translation to English from espacenet (Year: 2007).*
(Continued)

*Primary Examiner* — Abiy Teka
*Assistant Examiner* — Michael Quandt
(74) *Attorney, Agent, or Firm* — Crowell & Moring LLP

(57) ABSTRACT

A hydraulic drive system for a work machine including a hydraulic energy recovery device that is configured to perform load sensing control and accumulates hydraulic fluid that returns from a hydraulic cylinder in operation of lowering a front work implement into an accumulator includes, in order to prevent, when operation other than operation of lowering the front work implement is to be performed, hydraulic energy accumulated in the accumulator from being consumed uselessly, a regeneration selector valve in a hydraulic line for regenerating the hydraulic fluid accumulated in the accumulator into a hydraulic fluid supply line of a main pump. The regeneration selector valve is controlled such that, only when saturation occurs with the main pump, flow from the accumulator to the hydraulic fluid supply line is permitted.

6 Claims, 8 Drawing Sheets

(56) References Cited

U.S. PATENT DOCUMENTS

| | | | | |
|---|---|---|---|---|
| 2010/0000209 | A1* | 1/2010 | Wada | E02F 9/2285 60/413 |
| 2014/0174068 | A1 | 6/2014 | Mori et al. | |
| 2017/0114804 | A1 | 4/2017 | Helbling et al. | |
| 2017/0152645 | A1 | 6/2017 | Chioccola | |

FOREIGN PATENT DOCUMENTS

| | | | |
|---|---|---|---|
| JP | 2012-159131 | A | 8/2012 |
| JP | 2012-241742 | A | 12/2012 |
| JP | 2016-99001 | A | 5/2016 |
| KR | 10-2014-0063622 | | 5/2014 |
| WO | WO 2015/185699 | A1 | 12/2015 |

OTHER PUBLICATIONS

Notification Concerning Documents Transmitted (PCT/IB/310) issued in PCT Application No. PCT/JP2017/035671 dated May 16, 2019, including English translation of document C2 (Japanese-language Written Opinion (PCT/ISA/237) previously filed on Mar. 8, 2019) (six (6) pages).

International Search Report (PCT/ISA/210) issued in PCT Application No. PCT/JP2017/035671 dated Oct. 31, 2017 (three pages).

Japanese-language Written Opinion (PCT/ISA/237) issued in PCT Application No. PCT/JP2017/035671 dated Oct. 31, 2017 (four pages).

Korean-language Office Action issued in Korean Application No. 10-2019-7006942 dated Apr. 9, 2020 (five (5) pages).

* cited by examiner

TABLE 51a CHARACTERISTIC

TABLE 51b CHARACTERISTIC

TABLE 51c CHARACTERISTIC

HYDRAULIC DRIVE SYSTEM FOR WORK MACHINE

TECHNICAL FIELD

The present invention relates to a hydraulic drive system for a work machine such as a hydraulic excavator that includes a hydraulic fluid recovery device, and particularly to a hydraulic drive system for a work machine that includes a variable displacement hydraulic pump configured such that it performs load sensing control for controlling a delivery flow rate such that the delivery pressure becomes higher by a given set pressure than a maximum load pressure of one or more actuators and a hydraulic fluid recovery device for recovering hydraulic fluid energy from the hydraulic actuators.

BACKGROUND ART

A conventional technology relating to a hydraulic fluid recovery device in which, in a hydraulic drive system for a work machine such as a hydraulic excavator, hydraulic fluid returning from an actuator for moving a front work implement upwardly and downwardly in operation of lowering the front work implement is accumulated into an accumulator to recover potential energy of the front work implement and then, when operation other than the operation of lowering the front work implement is to be performed, the hydraulic fluid accumulated in the accumulator is regenerated into a hydraulic fluid supply line of a hydraulic pump is disclosed in Patent Document 1.

In Patent Document 1, the variable displacement hydraulic pump is configured to perform so-called load sensing control for controlling the delivery flow rate of the hydraulic pump such that the pump delivery pressure becomes higher by a given set pressure than a maximum load pressure of a plurality of actuators including a hydraulic cylinder that moves a front work implement upwardly and downwardly. Further, the hydraulic fluid recovery device includes a recovery flow control valve that short circuits, when the hydraulic cylinder for moving the front work implement upwardly and downwardly is contracted by the deadweight of the front work implement and so forth, the bottom side and the rod side of the cylinder (boom cylinder) thereby to raise the pressure at the bottom side and supplies the raised hydraulic fluid to the accumulator, and a regeneration flow control valve that regenerates, when the boom cylinder is extended against the load, the hydraulic fluid accumulated in the accumulator to the hydraulic fluid supply line of the hydraulic pump, and the recovery flow control valve and the regeneration flow control valve individually include a pressure compensating valve.

PRIOR ART DOCUMENT

Patent Document

Patent Document 1: JP-2007-170485-A

SUMMARY OF THE INVENTION

Problem to be Solved by the Invention

By using the hydraulic fluid recovery device disclosed in Patent Document 1, the pressure at the bottom side is raised by short circuit of the bottom side and the rod side of the boom cylinder by boom lowering operation and the raised hydraulic fluid is accumulated into the accumulator, and, upon boom raising operation, the hydraulic fluid accumulated in the accumulator can be regenerated efficiently into the hydraulic fluid supply line of the hydraulic pump.

Further, since the pressure compensating valve is provided in the recovery flow control valve and the regeneration flow control valve, the regenerative flow rate to be accumulated into the accumulator and the regeneration flow rate to be discharged from the accumulator to the hydraulic fluid supply line of the hydraulic pump can be controlled without suffering from an influence of pressure variation and the accumulation speed and the regeneration speed can be controlled accurately.

However, also when the conventional technology disclosed in Patent Document 1 is used, there is such a problem as described below.

In the hydraulic fluid recovery device disclosed in Patent Document 1, the hydraulic fluid accumulated in the accumulator through the recovery flow control valve from the bottom side of the boom cylinder by operation for moving down the front work implement, namely, boom lowering operation for contracting the boom cylinder, is regenerated, in boom raising operation for extending the boom cylinder, into the hydraulic fluid supply line of the hydraulic pump while the flow rate is controlled by the regeneration flow control valve, and the flow rate merging with the delivery flow rate of the hydraulic pump is guided to the flow control valve for boom cylinder control.

However, the hydraulic pump disclosed in Patent Document 1 is configured such that it performs load sensing control for controlling the delivery flow rate such that the delivery pressure becomes higher by a value determined in advance than a maximum load pressure of all actuators that are driven by the hydraulic pump, and, in order to discharge surplus hydraulic fluid to a reservoir, an unloading valve is provided in the hydraulic fluid supply line.

When the load sensing control is performed in this manner, the unloading valve is essentially required, and, in this case, when hydraulic fluid accumulated in the accumulator by operation for raising the front work implement, namely, by boom raising operation or the like, is merged into the hydraulic fluid supply line of the hydraulic pump through the regeneration flow control valve, when the pressure of the hydraulic fluid supply line is sufficiently high and has a higher value by a predetermined pressure than the load pressure of the boom cylinder (when a saturation state is reached), the flow rate merged from the accumulator to the hydraulic fluid supply line through the regeneration flow control valve is discharged as a surplus flow rate from the unloading valve described above to the reservoir, resulting in a problem that the hydraulic fluid accumulated in the accumulator cannot be effectively utilized for operation other than the boom lowering operation.

It is an object of the present invention to provide a hydraulic drive system for a work machine that performs a load sensing control and including a hydraulic fluid recovery device configured to accumulates a pressure of a hydraulic fluid returning from the actuator into an accumulator in operation of lowering a front work implement and recover a potential energy of the front work implement, in which when operation other than operation of lowering the front work implement is performed, the hydraulic fluid accumulated in the accumulator can be merged and regenerated into a hydraulic fluid supply line of a hydraulic pump and besides a hydraulic fluid energy accumulated in the accumulator is prevented from being consumed uselessly.

Means for Solving the Problem

In order to attain the object described above, according to the present invention, there is provided a hydraulic drive system for a work machine, comprising: a variable displacement hydraulic pump; one or more actuators that are driven by a hydraulic fluid delivered from the hydraulic pump and includes a hydraulic cylinder for moving a work device upwardly and downwardly; one or more flow control valves that control a flow of hydraulic fluid to be supplied from the hydraulic pump to the one or more actuators; a regulator that performs load sensing control for controlling a delivery flow rate of the hydraulic pump such that a delivery pressure of the hydraulic pump becomes higher than a maximum load pressure of the one or more actuators by a given set pressure; an unloading valve that opens and returns a hydraulic fluid of a hydraulic fluid supply line of the hydraulic pump to a reservoir when a pressure of the hydraulic fluid supply line becomes equal to or higher by a predetermined value than the maximum load pressure of the one or more actuators, the predetermined value being equal to or larger than the set pressure of the load sensing control; and a hydraulic energy recovery device that includes an accumulator connected to the hydraulic cylinder and the hydraulic fluid supply line of the hydraulic pump and accumulates a hydraulic fluid returned from the hydraulic cylinder into the accumulator when an operation of lowering the work machine is performed, and supplies and regenerates at least a part of the hydraulic fluid accumulated in the accumulator to the hydraulic fluid supply line of the hydraulic pump when an operation other than the operation of lowering the work machine is performed; wherein the hydraulic energy recovery device includes a regeneration selector valve device that controls a regeneration flow rate of a hydraulic fluid to be supplied from the accumulator to the hydraulic fluid supply line of the hydraulic pump; and the regeneration selector value device is configured to control a communication between the accumulator and the hydraulic fluid supply line of the hydraulic pump such that, when the difference between the pressure of the hydraulic fluid supply line of the hydraulic pump and the maximum load pressure is greater than the set pressure of the load sensing control, supply of the hydraulic fluid from the accumulator to the hydraulic fluid supply line of the hydraulic pump is limited, and when the difference between the pressure of the hydraulic fluid supply line of the hydraulic pump and the maximum load pressure is smaller than the set pressure of the load sensing control, supply of the hydraulic fluid from the accumulator to the hydraulic fluid supply line of the hydraulic pump is permitted.

In this way, by providing the regeneration selector valve device that controls the regeneration flow rate of hydraulic fluid to be supplied from the accumulator to the hydraulic fluid supply line of the hydraulic pump, and by configuring the regeneration selector valve device to control a communication between the accumulator and the hydraulic fluid supply line of the hydraulic pump such that, when the difference between the pressure of the hydraulic fluid supply line of the hydraulic pump and the maximum load pressure is greater than the set pressure of the load sensing control, supply of the hydraulic fluid from the accumulator to the hydraulic fluid supply line of the hydraulic pump is limited, and, when the difference between the pressure of the hydraulic fluid supply line of the hydraulic pump and the maximum load pressure is smaller than the set pressure of the load sensing control, supply of the hydraulic fluid from the accumulator to the hydraulic fluid supply line of the hydraulic pump is permitted, when a hydraulic fluid delivered from the hydraulic pump is sufficient for the demanded flow rate, the difference between the pressure of the hydraulic fluid supply line of the hydraulic pump and the maximum load pressure becomes greater than the set pressure of the load sensing control and regeneration from the accumulator into the hydraulic fluid supply line of the hydraulic pump is limited. Therefore, the hydraulic fluid energy accumulated in the accumulator can be prevented from being consumed uselessly by the unloading valve connected to the hydraulic fluid supply line.

On the other hand, when the hydraulic fluid delivered from the hydraulic pump is not sufficient (is insufficient) for the demanded flow rate, since the difference between the pressure of the hydraulic fluid supply line of the hydraulic pump and the maximum load pressure becomes smaller than the set pressure of the load sensing control and supply of the hydraulic fluid from the accumulator into the hydraulic fluid supply line of the hydraulic pump is permitted, the hydraulic fluid supplied from the accumulator is merged and regenerated with the hydraulic fluid delivered from the hydraulic pump and drives the actuator, and therefore a speedy work can be implemented.

Advantages of the Invention

With the present invention, by providing the regeneration selector valve device configured to control a communication between the accumulator and the hydraulic fluid supply line of the hydraulic pump, when the hydraulic fluid delivered from the hydraulic pump is sufficient for the demanded flow rate, since the difference between the pressure of the hydraulic fluid supply line of the hydraulic pump and the maximum load pressure becomes greater than the set pressure of the load sensing control and regeneration from the accumulator to the hydraulic fluid supply line of the hydraulic pump is limited, the hydraulic fluid energy accumulated in the accumulator can be prevented from being consumed uselessly by the unloading valve connected to the hydraulic fluid supply line.

On the other hand, when the hydraulic fluid delivered from the hydraulic pump is not sufficient (is insufficient) for the demanded flow rate, since the difference between the pressure of the hydraulic fluid supply line of the hydraulic pump and the maximum load pressure becomes smaller than the set pressure of the load sensing control and supply from the accumulator to the hydraulic fluid supply line of the hydraulic pump is permitted, the hydraulic fluid supplied from the accumulator is merged and regenerated with the hydraulic fluid delivered from the hydraulic pump and drives the actuator. Therefore, speedy work can be implemented.

In this manner, in the present invention, a hydraulic fluid energy accumulated in the accumulator can be utilized effectively.

MODES FOR CARRYING OUT THE INVENTION

In the following, embodiments of the present invention are described with reference to the drawings.

First Embodiment

The hydraulic drive system for a work machine according to the first embodiment of the present invention is described with reference to FIGS. 1 to 3D.

Configuration

Figure 1:
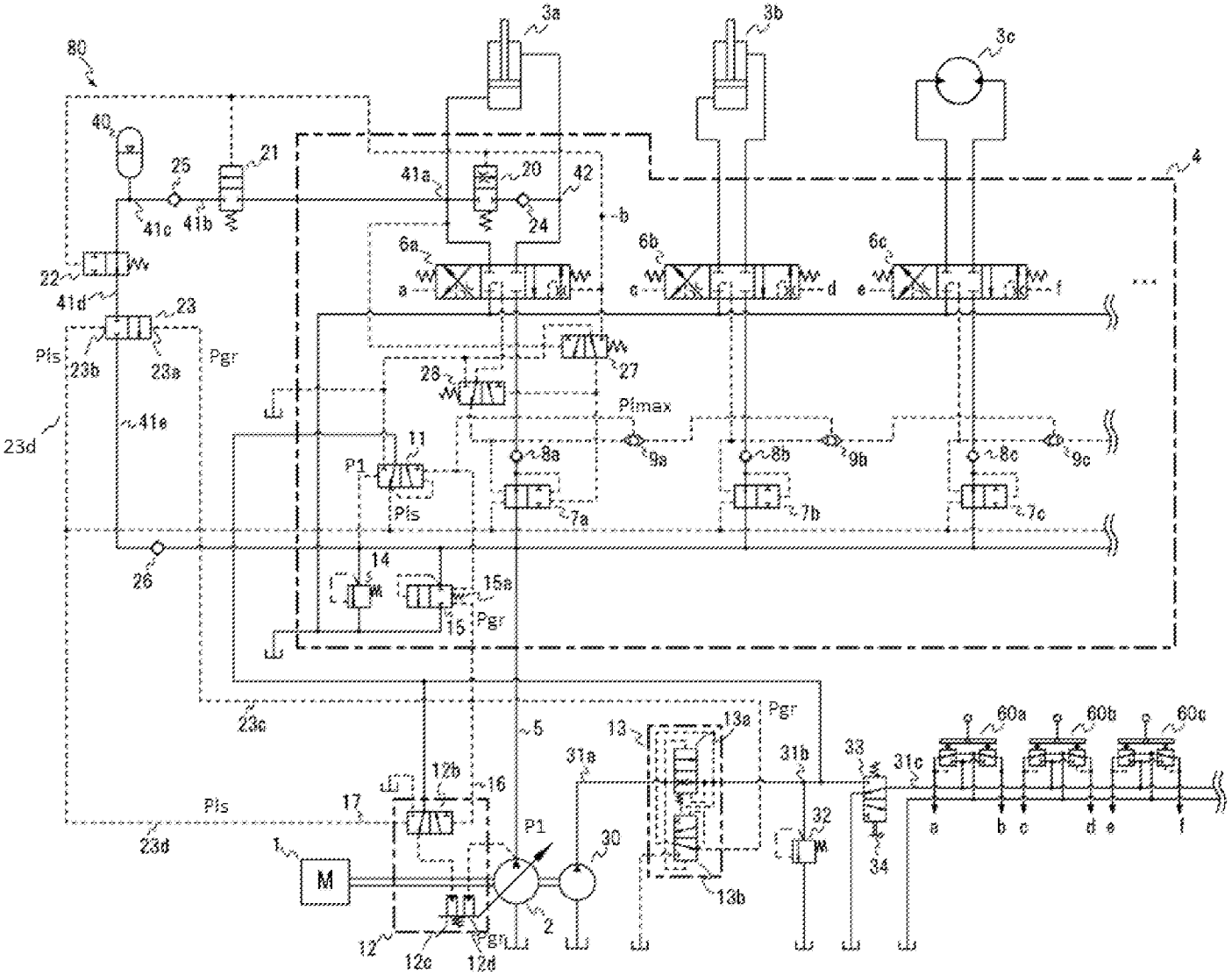
FIG. 1 is a view depicting a configuration of a hydraulic drive system for a work machine according to a first embodiment of the present invention.

FIG. 1 is a view depicting a configuration of the hydraulic drive system for a work machine according to the first embodiment of the present embodiment.

Referring to FIG. 1, the hydraulic drive system of the present embodiment includes a prime mover 1 (for example, a diesel engine), a main pump 2 that is a variable displacement type hydraulic cylinder to be driven by the prime mover 1, a fixed displacement type pilot pump 30 to be driven by the prime mover 1, a regulator 12 for controlling a delivery flow rate of the main pump 2, a boom cylinder 3*a*, an arm cylinder 3*b*, a swing motor 3*c*, a bucket cylinder 3*d*, a swing cylinder 3*e*, track motors 3*f* and 3*g* and a blade cylinder 3*h* (for 3*d* to 3*h*, refer to FIG. 2) that are a plurality of actuators driven with hydraulic fluid delivered from the main pump 2, a hydraulic fluid supply line 5 for introducing the hydraulic fluid delivered from the main pump 2 to the plurality of actuators 3*a*, 3*b*, 3*c*, 3*d*, 3*e*, 3*f*, 3*g* and 3*h* and a control valve block 4 that is connected to the downstream side of the hydraulic fluid supply line 5 and to which the hydraulic fluid delivered from the main pump 2 is introduced.

The control valve block 4 includes, in the inside thereof, a plurality of flow control valves 6*a*, 6*b*, 6*c*, 6*d*, 6*e*, 6*f*, 6*g* and 6*h* (6*d* to 6*h* are not depicted) for controlling the driving direction and the driving speed of the plurality of actuators 3*a*, 3*b*, 3*c*, 3*d*, 3*e*, 3*f*, 3*g* and 3*h*, a plurality of pressure compensating valves 7*a*, 7*b*, 7*c*, 7*d*, 7*e*, 7*f*, 7*g* and 7*h* (7*d* to 7*h* are not depicted) for controlling the differential pressure across the plurality of flow control valves 6*a*, 6*b*, 6*c*, 6*d*, 6*e*, 6*f*, 6*g* and 6*h*, check valves 8*a*, 8*b*, 8*c*, 8*d*, 8*e*, 8*f*, 8*g* and 8*h* (8*d* to 8*h* are not depicted), a relief valve 14 that is connected to the hydraulic fluid supply line 5 and performs control such that a pressure P1 of the hydraulic fluid supply line 5 is not raised to pressure equal to or higher than set pressure, shuttle valves 9*a*, 9*b*, 9*c*, 9*d*, 9*e*, 9*f*, and 9*g* (9*d* to 9*g* are not depicted) for detecting a maximum load pressure Pl max of the plurality of actuators 3*a*, 3*b*, 3*c*, 3*d*, 3*e*, 3*f*, 3*g* and 3*h*, an unloading valve 15 that opens and returns a hydraulic fluid of the hydraulic fluid supply line 5 to the reservoir when a pressure Pl of the hydraulic fluid supply line 5 becomes equal to or higher by a predetermined pressure (a set pressure obtained by adding a target LS differential pressure Pgr hereinafter described and a biasing force of a spring 15*a* to the maximum load pressure Pl max) than the maximum load pressure Pl max of the plurality of actuators 3*a*, 3*b*, 3*c*, 3*d*, 3*e*, 3*f*, 3*g* and 3*h* (namely, controls the pressure Pl of the hydraulic fluid supply line 5 so as not to increase to or higher than the set pressure), and a differential pressure reducing valve 11 that outputs a differential pressure between the pressure P1 of the hydraulic fluid supply line 5 and the maximum load pressure Pl max of the plurality of actuators 3*a*, 3*b*, 3*c*, 3*d*, 3*e*, 3*f*, 3*g* and 3*h* as absolute pressure Pls.

The unloading valve 15 may be configured otherwise such that it does not include the spring 15*a*, and in this case, the set pressure (predetermined pressure) of the unloading valve 15 is a value obtained by adding the target LS differential pressure Pgr to the maximum load pressure Pl max.

Hydraulic fluid delivered from the fixed displacement type pilot pump 30 flows to a hydraulic fluid supply line 31*b* via a hydraulic fluid supply line 31*a* and a prime mover rotational speed detection valve 13, and fixed pilot pressure Pi0 is generated by the pilot relief valve 32 connected to the hydraulic fluid supply line 31*b*. The prime mover rotational speed detection valve 13 includes a flow rate detection valve 13*a* connected between the hydraulic fluid supply line 31*a* and the hydraulic fluid supply line 31*b*, and a differential pressure reducing valve 13*b* that outputs a differential pressure across the flow rate detection valve 13*a* (differential pressure across the prime mover rotational speed detection valve 13) as an absolute pressure Pgr.

The flow rate detection valve 13*a* includes a variable throttle that increases the opening area thereof as the pass flow rate thereof (delivery flow rate of the pilot pump 30) increases, and delivery hydraulic fluid of the pilot pump 30 passes the variable throttle of the flow rate detection valve 13*a* and flows to the hydraulic fluid supply line 31*b* side. At this time, across the variable throttle of the flow rate detection valve 13*a*, a differential pressure is generated which increases as the pass flow rate therethrough increases, and the differential pressure reducing valve 13*b* outputs the differential pressure across the variable throttle as an absolute pressure Pgr. Since the delivery flow rate of the fixed displacement type pilot pump 30 varies depending upon the rotational speed of the prime mover 1, by detecting the differential pressure across the variable throttle of the flow rate detection valve 13*a*, the delivery flow rate of the pilot pump 30 can be detected and the rotational speed of the prime mover 1 can be detected. The absolute pressure Pgr outputted from the prime mover rotational speed detection valve 13 (differential pressure reducing valve 13*b*) is introduced as a target LS differential pressure to the regulator 12 and a regeneration selector valve 23 hereinafter described.

To the downstream of the pilot relief valve 32 of the hydraulic fluid supply line 31*b*, a hydraulic fluid supply line 31*c* is connected with a gate lock valve 33 interposed therebetween, and a pair of pilot valves (pressure reducing valves) provided in each of a plurality of operation devices 60*a*, 60*b*, 60*c*, 60*d*, 60*e*, 60*f*, 60*g* and 60*h* (60*d* to 60*h* are not depicted) are connected to the hydraulic fluid supply line 31*c*. The plurality of operation devices 60*a*, 60*b*, 60*c*, 60*d*, 60*e*, 60*f*, 60*g* and 60*h* (60*d* to 60*h* are not depicted) instruct operation of the corresponding actuators 3*a* to 3*h*, respectively, and the pilot valves generate operation pressures (operation signals) a, b; c, d; e, f . . . using a fixed pilot primary pressure Ppi0 generated by the pilot relief valve 32 as an original pressure by operating operation means such as operation levers, pedals or the like of the plurality of operation devices 60*a*, 60*b*, 60*c*, 60*d*, 60*e*, 60*f*, 60*g* and 60*h* (60*d* to 60*h* are not depicted). The operation pressures are introduced to the flow control valves 6*a* to 6*j* to perform selection operation of them. Further, by operating a gate lock lever 34 provided at the entrance of the operator's set of the hydraulic excavator (work machine), a gate lock lever 100 is operated, whereupon it is selectively controlled whether the pilot primary pressure Ppi0 generated by the pilot relief valve 32 is supplied to the hydraulic fluid supply line 31*b* as a pilot line (whether operation of the operation devices 60*a* to 60*h* is enabled) or hydraulic fluid of the hydraulic fluid supply line 31*b* is discharged to the reservoir (whether operation of the operation devices 60*a* to 60*h* is disabled).

The regulator 12 of the variable displacement type main pump 2 includes an LS valve 12*b*, a flow control piston 12*c* that operates with an output pressure of the LS valve 12*b* to control the delivery flow rate of the main pump 2 in response to a requested flow rate of the plurality of flow control valves 6*a*, 6*b*, 6*c*, 6*d*, 6*e*, 6*f*, 6*g* and 6*h*, and a horse power controlling piston 12*d* to which the pressure P1 of the hydraulic fluid supply line 5 of the main pump 2 is introduced to control tilting of the main pump 2 such that, as the pressure P1 increases, the tilting decreases such that the torque of the main pump 2 does not exceed a torque determined in advance.

To the LS valve 12*b*, a target LS differential pressure Pgr that is an output pressure of the prime mover rotational speed detection valve 13 and an LS differential pressure Pls that is an output pressure of the differential pressure reducing valve 11 are introduced through hydraulic lines 16 and 23*d*, and the LS valve 12*b* controls the flow control piston 12*c* such that, when the LS differential pressure Pls is higher than the target LS differential pressure Pgr, the LS valve 12*b* introduces the fixed pilot pressure Ppi0 to the flow control piston 12*c* to decrease the delivery flow rate of the main pump 2, and when the LS differential pressure Pls is lower than the target LS differential pressure Pgr, the LS valve 12*b* discharges hydraulic fluid of the flow control piston 12*c* to the reservoir to increase the flow rate of the main pump 2.

The control valve block 4 further includes a regeneration selector valve 20 and selector valves 27 and 28.

A bottom side hydraulic line 41*a* and a rod side hydraulic line 42 of the boom cylinder 3*a* are connected to each other through the regeneration selector valve 20 and a check valve 24.

Figure 3A:
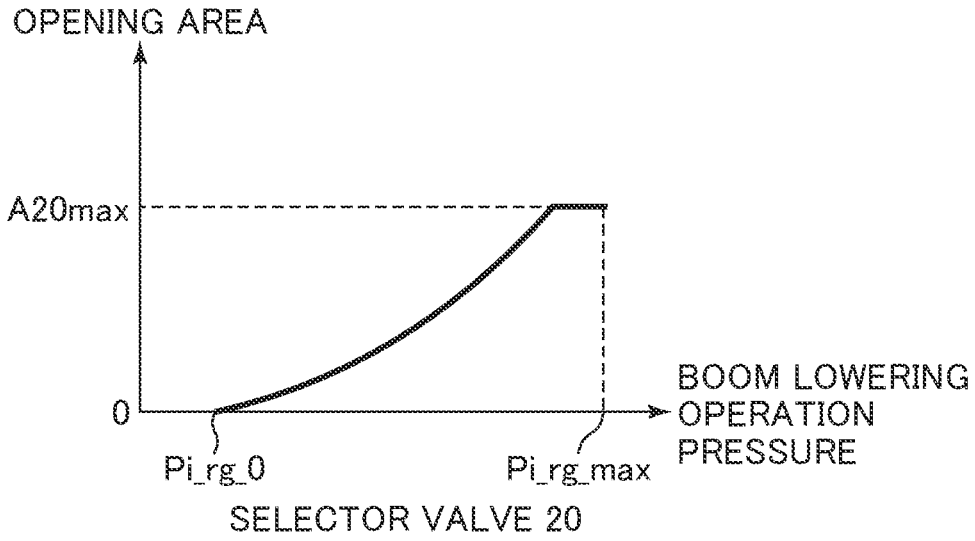
FIG. 3A is a view depicting an opening area characteristic of a regeneration selector valve disposed between a bottom side line and a rod side line of a boom cylinder.

FIG. 3A is a view depicting an opening area characteristic of the regeneration selector valve 20. As depicted in FIG. 3A, the regeneration selector valve 20 has such a characteristic that, when a boom lowering operation pressure b is not applied, the regeneration selector valve 20 is a closed position, and as the boom lowering operation pressure b increases, the opening area thereof increases. In FIG. 3A, reference character Pi_rg_0 represents a minimum effective boom lowering operation pressure, Pi_rg_max represents a maximum boom lowering operation pressure, and A20*max* represents a maximum opening area.

A selector valve 27 selectively controls to output a reservoir pressure when the pressure of the bottom side hydraulic line 41*a* of the boom cylinder 3*a* is lower than a given value determined in advance and output the operation pressure b (boom lowering operation pressure) that is an output pressure of the pilot valve of the operation device 60*a* when the pressure of the hydraulic line 41*a* is equal to or higher than the given value determined in advance. The pressure outputted from the selector valve 27 is introduced in a direction in which it switches the pressure compensating valve 7*a* in its closing position. Further, the spring force of the selector valve 27 is set such that the selector valve 27 is actuated in the rightward direction in the figure (to a position in which the boom lowering operation pressure b is outputted) by the pressure of the bottom side hydraulic line 41*a* of the boom cylinder 3*a* in a state in which a front work implement 104 is not grounded.

A selector valve 28 selectively controls such that, when the selector valve 27 introduces the reservoir pressure to the pressure compensating valve 7*a*, the selector valve 28 introduces the load pressure of the boom cylinder 3*a* obtained through the flow control valve 6*a* of the boom cylinder 3*a* in a direction in which the pressure compensating valve 7*a* is actuated in its opening direction and simultaneously introduces the load pressure of the boom cylinder 3*a* to the shuttle valve 9*a* provided for outputting the maximum load pressure Pl max, and when the selector valve 27 introduces the operation pressure b (boom lowering operation pressure) that is an output pressure of the pilot valve of the operation device 60*a* in a direction in which the pressure compensating valve 7*a* is actuated in its closing direction, the selector valve 28 introduces the reservoir pressure in a direction in which the pressure compensating valve 7*a* is actuated in its opening direction and simultaneously introduces the reservoir pressure to the shuttle valve 9*a*.

Further, the hydraulic drive system of the present embodiment includes a hydraulic fluid recovery device 80. The hydraulic fluid recovery device 80 includes an accumulator 40 and accumulates a hydraulic fluid returned from the boom cylinder 3*a* as one of the front actuators into the accumulator 40 to recover the potential energy of the front work implement 104 when an operation of lowering the front work implement 104 (see FIG. 2) is performed, and supplies and regenerates at least a part of the hydraulic fluid accumulated in the accumulator 40 to the hydraulic fluid supply line 5 of the main pump 2 when an operation other than the operation of lowering the front work implement 104 is performed.

The hydraulic fluid recovery device 80 includes, in addition to the accumulator 40, selector valves 21 and 22 and a regeneration selector valve 23 (first regeneration selector valve), and check valves 25 and 26, and the bottom side hydraulic line 41*a* of the boom cylinder 3*a* is connected to the hydraulic fluid supply line 5 through the selector valve 21, check valve 25, selector valve 22, regeneration selector valve 23, check valve 26 and an internal line of the control valve block 4.

The accumulator 40 is connected to a hydraulic line 41*c* between the check valve 25 and the selector valve 22. To the selector valves 21 and 22, the operation pressure b (boom lowering operation pressure) that is an output pressure of the pilot valve of the operation device 60*a* is introduced.

Figure 3B:
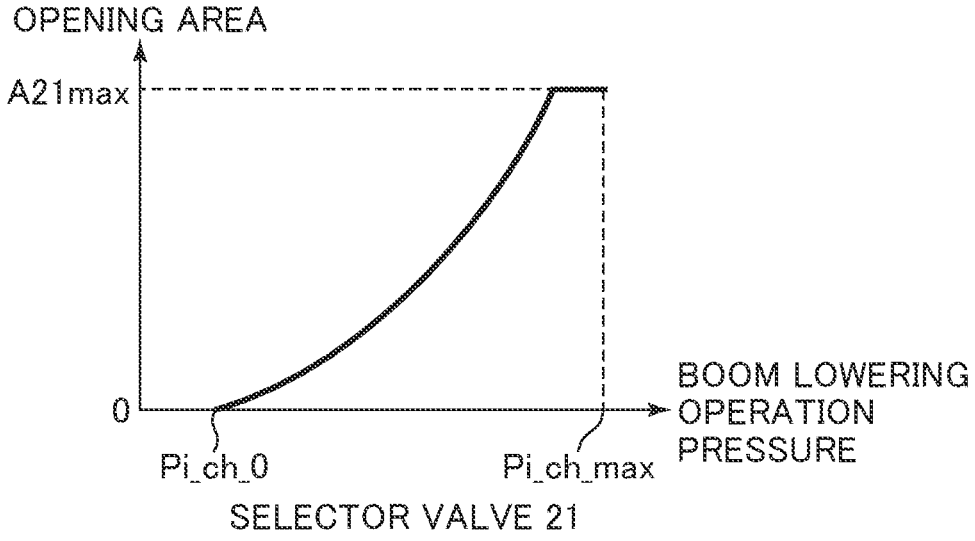
FIG. 3B is a view depicting an opening area characteristic of a selector valve disposed on a line branched from the bottom side line of the boom cylinder and extending to an accumulator.

FIG. 3B is a view depicting an opening area characteristic of the selector valve 21.

As depicted in FIG. 3B, the selector valve 21 has such a characteristic that, when the boom lowering operation pressure b is not applied, the selector valve 21 interrupts a hydraulic line 41*b* between the selector valve 21 and the check valve 25, and as the boom lowering operation pressure b increases, the opening area between the bottom side hydraulic line 41*a* and the hydraulic line 41*b* increases. In FIG. 3B, reference character Pi_ch_0 represents a minimum effective boom lowering operation pressure, Pi_ch_max represents a maximum boom lowering operation pressure, and A21*max* represents a maximum opening area.

Figure 3C:
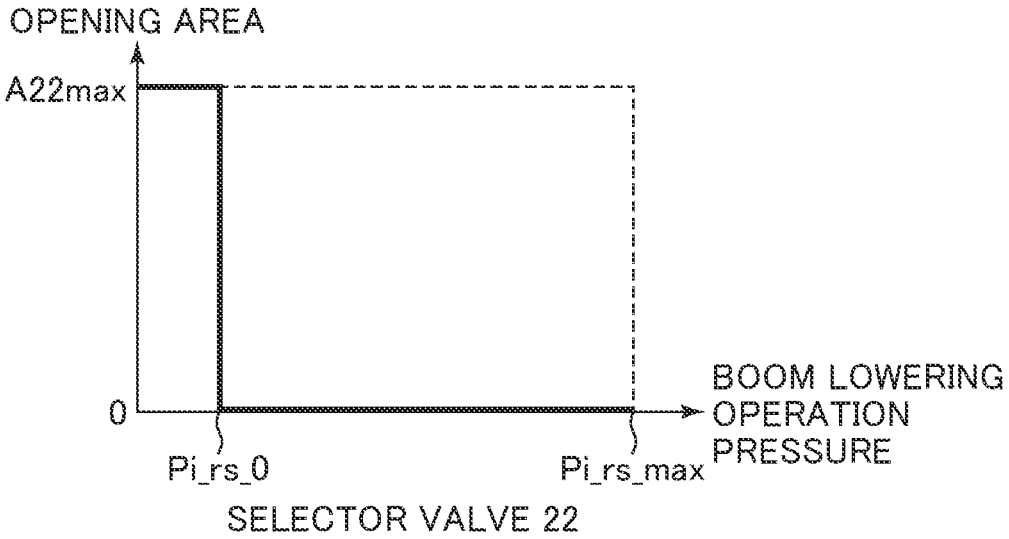
FIG. 3C is a view depicting an opening area characteristic of the selector valve disposed in a line communicating with the accumulator.

FIG. 3C is a view depicting an opening area characteristic of the selector valve 22.

The selector valve 22 has, conversely to the selector valve 21, such a characteristic that, as depicted in FIG. 3C, when the boom lowering operation pressure b is not applied, the selector valve 22 communicates a hydraulic line 41*d* between the selector valve 22 and the regeneration selector valve 23, and when the boom lowering operation pressure b is applied, then the selector valve 22 interrupts a communication between the hydraulic line 41*c* and the hydraulic line 41*d*. In FIG. 3C, reference character Pi_rs_0 represents a maximum boom lowering operation pressure, Pi_rs_max represents a maximum boom lowering operation pressure, and A22*max* represents a maximum opening area.

At the opposite ends of the regeneration selector valve 23, a pressure receiving portion 23*a* (first pressure receiving portion) to act in a valve opening direction and a pressure receiving portion 23*b* (second pressure receiving portion) to act in a valve closing direction are provided, and to the pressure receiving portion 23*a*, a target LS differential pressure Pgr is introduced though a hydraulic line 23*c* (first hydraulic line) while, to the pressure receiving portion 23*b*, an LS differential pressure Pls (pressure of the difference between the pressure P1 of the hydraulic fluid supply line 5 of the main pump 2 and the maximum load pressure Plmax) is introduced through the hydraulic line 23*d* (second hydraulic line). In this manner, to the opposite ends of the regeneration selector valve 23, the target LS differential pressure Pgr is introduced in a direction in which it acts in a valve opening direction and the LS differential pressure Pls acts in a direction in which it acts in a valve closing direction.

Figure 3D:
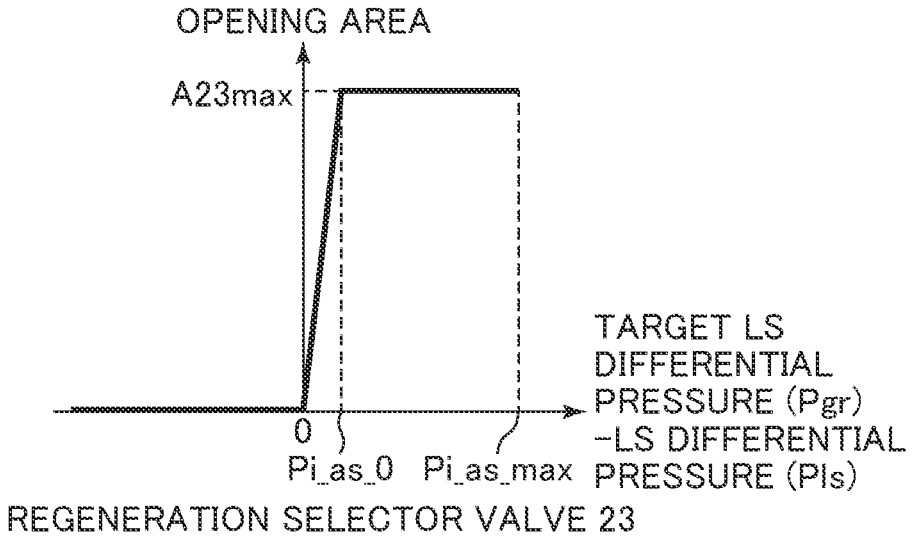
FIG. 3D is a view depicting an opening area characteristic of the regeneration selector valve (first regeneration selector valve) disposed in a line for communicating the accumulator with the hydraulic fluid supply line of a main pump.

FIG. 3D is a view depicting an opening area characteristic of the regeneration selector valve 23.

The regeneration selector valve 23 has such a characteristic that, as depicted in FIG. 3D, when the LS differential pressure Pls is higher than the target LS differential pressure Pgr (Pls>Pgr), the regeneration selector valve 23 interrupts a communication between the hydraulic line 41*d* and a regeneration hydraulic line 41*e* at a portion thereof between the regeneration selector valve 23 and the check valve 26, and when the LS differential pressure Pls becomes lower than the target LS differential pressure Pgr (Pls<Pgr), then the regeneration selector valve 23 opens immediately and fully opens with a differential pressure deviation Pi_as_0 to establish a communication between the hydraulic line 41*d* and the regeneration hydraulic line 41*e*. In FIG. 3D, reference character Pi_as_0 represents a minimum effective differential pressure deviation, Pi_as_max represents a maximum differential pressure deviation, and A23*max* represents a maximum opening area.

In the foregoing, the regeneration selector valve 23, pressure receiving portions 23*a* and 23*b* and hydraulic lines 23*c* and 23*d* function as a regeneration selector valve device that controls the regeneration flow rate of a hydraulic fluid to be supplied from the accumulator 40 to the hydraulic fluid supply line 5 of the main pump 2.

Further, with the regeneration selector valve 23, pressure receiving portions 23*a* and 23*b* and hydraulic lines 23*c* and 23*d*, the regeneration selector valve device is configured to control a communication between the accumulator 40 and the hydraulic fluid supply line 5 of the main pump 2 such that, when the LS differential pressure Pls that is the difference between the pressure P1 of the hydraulic fluid supply line 5 of the main pump 2 and the maximum load pressure Pl max is greater than the target LS differential pressure Pgr that is a set pressure for the load sensing control, supply of hydraulic fluid from the accumulator 40 to the hydraulic fluid supply line 5 of the main pump 2 is limited (in the present embodiment, inhibited), and when the LS differential pressure Pls that is the difference between the pressure P1 of the hydraulic fluid supply line 5 of the main pump 2 and the maximum load pressure Pl max is smaller than the target LS differential pressure Pgr for the load sensing control, supply of hydraulic fluid from the accumulator 40 to the hydraulic fluid supply line 5 of the main pump 2 is permitted.

Further, in the present embodiment, the pressure receiving portions 23*a* and 23*b* and the hydraulic lines 23*c* and 23*d* function as a selection control device configured to actuate the regeneration selector valve 23 (first regeneration selector valve) to a position to interrupt the regeneration hydraulic line 41*e* when the LS differential pressure Pls that is the difference between the pressure P1 of the hydraulic fluid supply line 5 of the main pump 2 and the maximum load pressure Pl max is greater than the target LS differential pressure Pgr for the load sensing control, and actuate the regeneration selector valve 23 to a position to communicate the regeneration hydraulic line 41*e* when the LS differential pressure Pls that is the difference between the pressure P1 of the hydraulic fluid supply line 5 of the main pump 2 and the maximum load pressure Pl max is smaller than the target LS differential pressure Pgr for the load sensing control.

Figure 2:
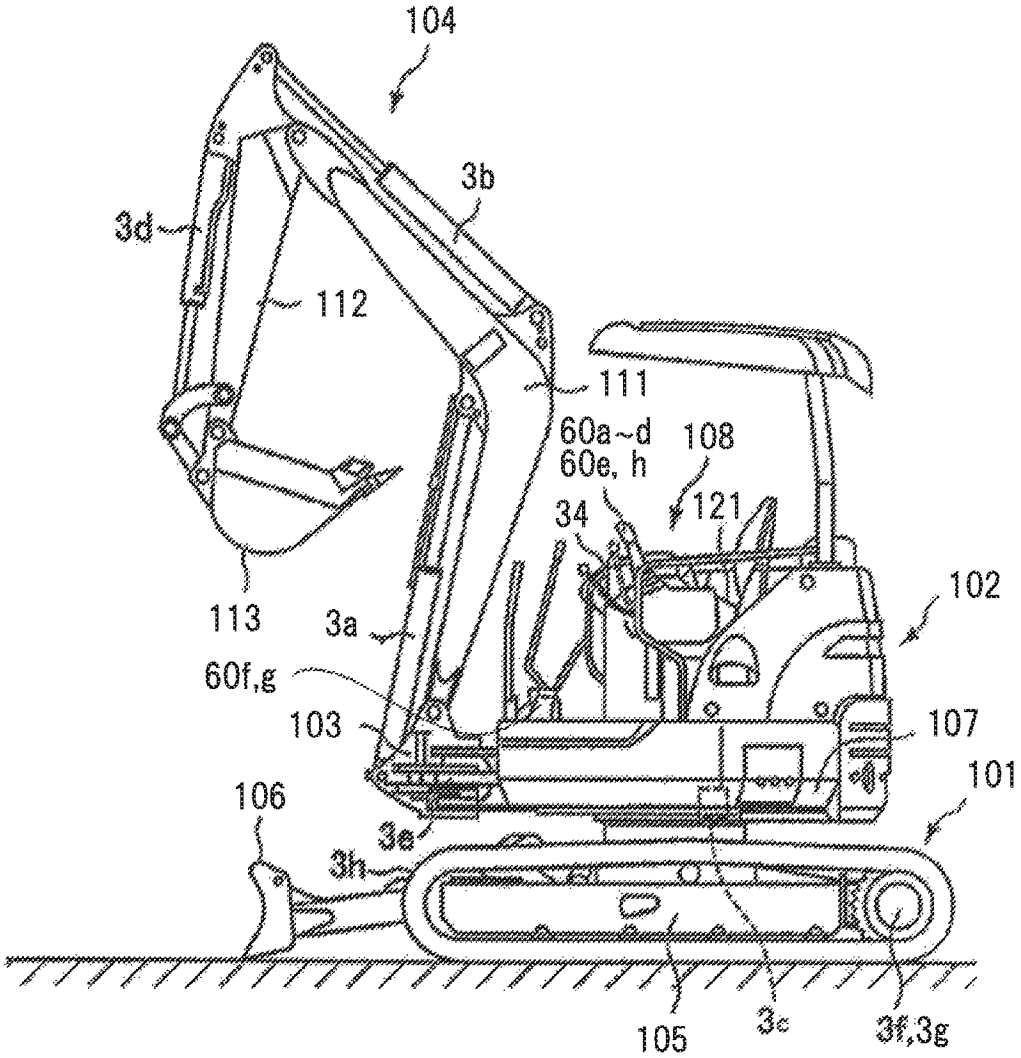
FIG. 2 is a view depicting an appearance of a hydraulic excavator in which the hydraulic drive system according to the first embodiment of the present invention is incorporated.

FIG. 2 is a view depicting an appearance of a hydraulic excavator in which the hydraulic drive system described above is incorporated.

The hydraulic excavator includes an upper swing structure 102, a lower travel structure 101, and a front work implement 104 of the swing type, and the front work implement 104 is configured from a boom 111, an arm 112 and a bucket 113. The upper swing structure 102 is swingable by rotation of the swing motor 3*c* with respect to the lower travel structure 101. A swing post 103 is provided at a front portion of the upper swing structure, and the front work implement 104 is attached for upward and downward movement to the swing post 103. The swing post 103 is swingable in a horizontal direction with respect to the upper swing structure 102 by elongation and contraction of the swing cylinder 3*e*, and the boom 111, arm 112 and bucket 113 of the front work implement 104 are swingable in the upward and downward direction by extension and contraction of the boom cylinder 3*a*, arm cylinder 3*b* and bucket cylinder 3*d*. A blade 106 that performs upward and downward movement by elongation and contraction of the blade cylinder 3*h* is attached to a central frame 105 of the lower travel structure 101. The lower travel structure 101 travels by driving left and right crawler belts by rotation of the travel motors 3*f* and 3*g*.

A cabin 108 is installed on the upper swing structure 102, and in the cabin 108, a driver's seat 121, the operation devices 60*a* to 60*d* for the boom cylinder 3*a*, arm cylinder 3*b*, bucket cylinder 3*d* and swing motor 3*c*, the operation device 60*e* for the swing cylinder 3*e*, the operation device 60*h* for the blade cylinder 3*h*, the operation devices 60*f* and 60*g* for the track motors 3*f* and 3*g*, and the gate lock lever 34 are provided. Each of the operation devices 60*a* to 60*d*, operation device 60*e*, operation device 60*h* and operation devices 60*f* and 60*g* is an operation lever device capable of being operated by an operation lever, and each of the operation devices 60*f* and 60*g* for the track motors 3*f* and 3*g* can be operated also by a pedal. Further, the operation devices 60*a* to 60*d* for the boom cylinder 3*a*, arm cylinder 3*b*, bucket cylinder 3*d* and swing motor 3*c* are configured as operation lever devices each including two operation levers disposed, for example, on the left and right of the driver's seat 121 and individually operable in an arbitrary direction with reference to cross directions from their neutral position. For example, when the operation lever of the operation lever device on the left side is operated in the forward and backward direction, then it functions as the operation device 60*c* for swing; when the operation lever is operated in the leftward and rightward direction, then it functions as the operation device 60*b* for the arm. Meanwhile, when the operation lever of the operation lever device on the right side is operated in the forward and backward direction, then it functions as the operation device 60*a* for the boom, and when the operation lever is operated in the leftward and rightward direction, then it functions as an operation device for the bucket.

Further, the bottom side pressure receiving area and the rod side pressure receiving area of the boom cylinder 3*a* have a difference therebetween and have a relationship of the bottom side pressure receiving area>rod side pressure receiving area.

Operation

Operation of the present embodiment is described with reference to FIGS. 1 to 3.

Hydraulic fluid delivered from the fixed displacement type pilot pump 30 is supplied to the hydraulic fluid supply line 31*a*, and the delivery flow rate of the pilot pump 30 is outputted as a target LS differential pressure Pgr by the prime mover rotational speed detection valve 13 connected to the downstream of the hydraulic fluid supply line 31*a*.

To the downstream of the prime mover rotational speed detection valve 13, the pilot relief valve 32 is connected, by which a fixed pilot primary pressure Ppi0 is generated in the hydraulic fluid supply line 31*b*.

(a) Where All Operation Levers are Neutral

Since the operation levers of all of the operation devices 60*a*, 60*b*, 60*c*, 60*d*, 60*e*, 60*f*, 60*g* and 60*h* are neutral, also all pilot valves become neutral, and all of the flow control valves 6*a*, 6*b*, 6*c*, 6*d*, 6*e*, 6*f*, 6*g* and 6*h* are held at their neutral position by the springs provided at the opposite ends of them.

When the pressure of the bottom side hydraulic line 41*a* of the boom cylinder 3*a* is lower than a pressure determined in advance by the springs of the selector valve 27 (for example, when the front work implement 104 is grounded and no holding pressure is applied upon the boom cylinder 3*a* or in a like case), the selector valve 27 is actuated in the leftward direction in the figure to introduce the reservoir pressure to the pressure compensating valve 7*a* and the selector valve 28.

The selector valve 28 is actuated in the rightward direction in the figure by the springs to connect the load pressure detection hydraulic line of the flow control valve 6*a* to the pressure compensating valve 7*a* and the shuttle valve 9*a*.

When the pressure of the bottom side hydraulic line 41*a* of the boom cylinder 3*a* is higher than the pressure determined in advance by the springs of the selector valve 27 (for example, when the front work implement 104 is not grounded and holding force is applied upon the boom cylinder 3*a* or in a like case), the selector valve 27 is actuated in the rightward direction in the figure and introduces the boom lowering operation pressure b to the pressure compensating valve 7*a* and the selector valve 28. However, since all levers are neutral, also the boom lowering operation pressure b is equal to the reservoir pressure.

In this manner, when all operation levers are neutral, since the flow control valves 6*a*, 6*b*, 6*c*, 6*d*, 6*e*, 6*f*, 6*g* and 6*h* are at their neutral position, the reservoir pressure is introduced as a maximum load pressure Pl max to the differential pressure reducing valve 11 and the unloading valve 15 through the flow control valves 6*a*, 6*b*, 6*c*, 6*d*, 6*e*, 6*f*, 6*g* and 6*h* and the shuttle valves 9*a*, 9*b*, 9*c*, 9*d*, 9*e*, 9*f*, and 9*g*.

The pressure P1 of the hydraulic fluid supply line 5 is held a little higher than the output pressure Pgr (target LS differential pressure) by the spring 15*a* provided in the unloading valve 15 and the output pressure Pgr (target LS differential pressure) of the prime mover rotational speed detection valve 13 introduced in the direction in which the unloading valve 15 is closed (p1>Pgr).

Although the differential pressure reducing valve 11 outputs the differential pressure between the pressure P1 of the hydraulic fluid supply line 5 and the maximum load pressure Pl max as the LS differential pressure Pls, when all levers are neutral, since the maximum load pressure Pl max is equal to the reservoir pressure as described hereinabove, Pls=P1−Pl max=P1>Pgr is satisfied.

The target LS differential pressure Pgr and the LS differential pressure Pls are introduced into the LS valve 12*b* in the regulator 12 of the variable displacement type main pump 2, and the regulator 12 compares the LS differential pressure Pls and the target LS differential pressure Pgr with each other and discharges, in the case of Pls<Pgr, hydraulic fluid of the flow control piston 12*c* to the reservoir, and introduces, when Pls>Pgr, the fixed pilot primary pressure Ppi0 generated in the hydraulic fluid supply line 31*b* by the pilot relief valve 32 to the flow control piston 12*c*.

As described hereinabove, when all operation levers are neutral, Pls>Pgr is satisfied, and therefore, the regulator 12 is actuated in the rightward direction in the figure and the pilot primary pressure Ppi0 kept fixed by the pilot relief valve 32 is introduced to the flow control piston 12*c*.

Since the pilot primary pressure Ppi0 is introduced to the flow control piston 12*c*, the displacement of the variable displacement type main pump 2 is kept in the minimum.

On the other hand, since the boom lowering operation pressure b is equal to the reservoir pressure, the selector valves 21 and 22 are kept at their closed position and the communication position depicted in the figure, respectively, and therefore, the bottom side hydraulic line 41*a* of the boom cylinder 3*a* and the hydraulic line 41*c* to which the accumulator 40 is connected are cut off from each other, and the hydraulic line 41*d* between the hydraulic line 41*c* to which the accumulator 40 is connected and the regeneration selector valve 23 is communicated with each other.

As described hereinabove, when all operation levers are neutral, since Pls>Pgr is satisfied, the regeneration selector valve 23 is actuated in the rightward direction in the figure, in short, to the closing position, and hydraulic fluid of the accumulator 40 is blocked from flowing into the hydraulic fluid supply line 5 through the check valve 26.

(b) Where a Boom Lowering Operation is Performed from a State in which the Front Work Implement is Not Grounded A boom lowering operation pressure b is outputted from the pilot valve of the boom operation device 60*a*. By the boom lowering operation pressure b, the flow control valve 6*a* is actuated in the leftward direction in the figure.

In a state in which the front work implement 104 is not grounded, the selector valve 27 is actuated in the rightward direction in the figure by the pressure of the bottom side hydraulic line 41*a* of the boom cylinder 3*a* to introduce the boom lowering operation pressure b to the pressure compensating valve 7*a* and the selector valve 28.

The pressure compensating valve 7*a* is held at the closed position by the boom lowering operation pressure b introduced to the closing direction of the pressure compensating valve 7*a*.

On the other hand, the selector valve 28 is actuated in the leftward direction in the figure by the boom lowering operation pressure b to introduce the reservoir pressure to the pressure compensating valve 7*a* and the shuttle valve 9*a*.

In this manner, similarly as in "(a) the case in which all of the operation levers are neutral," the reservoir pressure is introduced as a maximum load pressure Pl max to the differential pressure reducing valve 11 and the unloading valve 15 through the shuttle valve 9*a*, and the pressure P1 of the hydraulic fluid supply line 5 is held a little higher than the target LS differential pressure Pgr by the unloading valve 15.

Although the differential pressure reducing valve 11 outputs the LS differential pressure Pls, since the maximum load pressure Pl max is equal to the reservoir pressure, Pls=P1−Pl max=P1>Pgr is satisfied.

As described hereinabove, when a boom lowering operation is performed from the state in which the front work implement 104 is not grounded, since Pls>Pgr is satisfied, the LS valve 12*b* is actuated in the rightward direction in the figure, and the pilot primary pressure Ppi0 kept fixed by the pilot relief valve 32 is introduced to the flow control piston 12*c* and the displacement of the variable capacitance type main pump 2 is kept in the minimum.

On the other hand, the regeneration selector valve 20 and the selector valve 21 are actuated to their open position and the selector valve 22 is actuated to its closed position by the boom lowering operation pressure b.

Hydraulic fluid of the bottom side hydraulic line 41*a* of the boom cylinder 3*a* is introduced to the rod side hydraulic line 42 of the boom cylinder 3*a* through the check valve 24 and merges with hydraulic fluid supplied from the flow control valve 6*a* to drive the boom cylinder 3*a* in its contraction direction.

Here, since the bottom side pressure receiving area and the rod side pressure receiving area of the boom cylinder 3*a* have a difference therebetween and satisfy the bottom side pressure receiving area>rod side pressure receiving area, if the boom cylinder 3*a* is contracted, then the flow rate flowing out from the bottom side pressure receiving chamber is higher than the flow rate flowing into the rod side pressure receiving chamber. Consequently, by hydraulic fluid supplied from the bottom side hydraulic line 41*a* of the boom cylinder 3*a* to the rod side hydraulic line 42 through the regeneration selector valve 20 and the check valve 24, the pressure in both of the bottom side hydraulic line 41*a* and the rod side hydraulic line 42 of the beam cylinder 3*a* increases.

Further, the hydraulic fluid of the bottom side hydraulic line 41*a* of the boom cylinder 3*a* whose pressure is increased in this manner is discharged to the reservoir through a meter out opening on the boom lowering side of the flow control valve 6*a* and is simultaneously accumulated into the accumulator 40 through the selector valve 21 and the check valve 25 because the selector valve 21 is actuated to the open position and the selector valve 22 is actuated to the closed position as described above.

(c) Where a Boom Raising Operation is Performed in a State in which Hydraulic Fluid is Accumulated in the Accumulator A boom raising operation pressure a is outputted from the pilot valve of the boom operation device 60*a* for the boom. By the boom raising operation pressure a, the flow control valve 6*a* is actuated in the rightward direction in the figure.

When the pressure of the bottom side hydraulic line 41*a* of the boom cylinder 3*a* is lower than a pressure determined in advance by the spring of the selector valve 27 (for example, when the front work implement 104 is grounded and no holding pressure is applied upon the boom cylinder 3*a* or in a like case), the selector valve 27 is actuated in the leftward direction in the figure by the spring thereof to introduce the reservoir pressure to the pressure compensating valve 7*a* and the selector valve 28.

The selector valve 28 is actuated in the rightward direction in the figure to connect the load pressure detection hydraulic line of the flow control valve 6*a* to the pressure compensating valve 7*a* and the shuttle valve 9*a*.

When the pressure of the bottom side hydraulic line 41*a* of the boom cylinder 3*a* is higher than a pressure determined in advance by the selector valve 27 (for example, when the front work implement 104 is not grounded and a holding pressure is applied upon the boom cylinder 3*a* or in a like case), the selector valve 27 is actuated in the rightward direction in the figure to introduce the boom lowering operation pressure b to the pressure compensating valve 7*a* and the selector valve 28. However, upon a boom raising operation, since the boom lowering operation pressure b is equal to the reservoir pressure, the selector valve 28 is actuated in the rightward direction in the figure to connect the load pressure detection hydraulic line of the flow control valve 6*a* to the pressure compensating valve 7*a* and the shuttle valve 9*a*.

In this manner, when a boom raising operation is performed, the load pressure of the boom cylinder 3*a* (pressure of the hydraulic line 41*a*) is introduced to the shuttle valve 9*a* through the flow control valve 6*a* and the selector valve 28 and is introduced as a maximum load pressure Pl max to the differential pressure reducing valve 11 and the unloading valve 15.

By the maximum load pressure Pl max introduced to the unloading valve 15, the spring 15*a* of the unloading valve 15 and the target LS differential pressure Pgr, the set pressure of the unloading valve 15 increases to a value that is the sum when the target LS differential pressure Pgr and the biasing force of the spring 15*a* (hereinafter referred to as spring force) to the load pressure Pl max of the boom cylinder 3*a*, whereupon the hydraulic line for discharging hydraulic fluid of the hydraulic fluid supply line 5 to the reservoir is interrupted.

Further, although the differential pressure reducing valve 11 outputs P1−Pl max as the LS differential pressure Pls by the maximum load pressure Pl max introduced to the differential pressure reducing valve 11, at the moment of activation in the boom raising direction, since the pressure P1 of the hydraulic fluid supply line 5 is kept to a low pressure determined in advance by the spring 15*a* of the unloading valve 15 and the LS differential pressure Pgr, the LS differential pressure Pls becomes substantially equal to the reservoir pressure.

The LS differential pressure Pls is introduced to the LS valve 12*b* in the regulator 12 of the variable displacement type main pump 2.

Since, upon boom raising activation, Pls=reservoir pressure<Pgr is satisfied as described above, the LS valve 12*b* is actuated in the leftward direction in the figure and hydraulic fluid of the flow control piston 12*c* is discharged to the reservoir through the LS valve 12*b*.

Therefore, the flow rate of the main pump 2 gradually increases, and this flow rate increase continues until the LS differential pressure Pls becomes equal to the target LS differential pressure Pgr.

On the other hand, since the boom lowering operation pressure b is equal to the reservoir pressure, the selector valves 21 and 22 are held at the closed position and the communication position, respectively. The bottom side hydraulic line 41*a* of the boom cylinder 3*a* and the hydraulic line 41*c* to which the accumulator 40 is connected are cut off from each other while the hydraulic line 41*d* between the hydraulic line 41*c* to which the accumulator 40 is connected and the regeneration selector valve 23 is communicated, and hydraulic fluid of the accumulator 40 is introduced to the regeneration selector valve 23.

Since, upon boom raising activation, Pls<Pgr is satisfied, the regeneration selector valve 23 is actuated in the leftward direction in the figure, namely, to the communication position, and when the pressure of the hydraulic line 41*c* to which the accumulator 40 is connected is higher than that of the hydraulic fluid supply line 5, hydraulic fluid of the accumulator 40 flows into the hydraulic fluid supply line 5 through the check valve 26 and is regenerated.

Consequently, the hydraulic fluid supplied from the accumulator 40 and the hydraulic fluid delivered from the main pump 2 merge with each other and are supplied to the bottom side of the boom cylinder 3*a* through the flow control valve 6*a* to drive the boom cylinder 3*a*. Therefore, speedy activation of boom raising becomes possible and good operability can be implemented.

As the flow rate of the variable displacement type main pump 2 gradually increases to gradually increase the LS differential pressure Pls until the LS differential pressure Pls becomes equal to the target LS differential pressure Pgr, the regeneration selector valve 23 is actuated to the closed position as depicted in FIG. 3D.

Consequently, since regeneration from the accumulator 40 to the hydraulic fluid supply line 5 of the main pump 2 is inhibited, the hydraulic energy accumulated in the accumulator 40 can be prevented from being consumed wastefully by the unloading valve 15 connected to the hydraulic fluid supply line 5.

(d) Where Boom Raising and Arm Crowding are Operated Simultaneously in a State in Which Hydraulic Fluid is Accumulated in the Accumulator A boom raising operation pressure a is outputted from the pilot valve of the boom operation device 60*a* and an arm crowd operation pressure c is outputted from the pilot valve of the arm operation device 60*b*. The flow control valve 6*a* is actuated in the rightward direction in the figure by the boom raising operation pressure a and the flow control valve 6*b* is actuated in the rightward direction in the figure by the arm crowd operation pressure c.

When the front work implement 104 is not grounded and the pressure of the bottom side hydraulic line 41*a* of the boom cylinder 3*a* is higher than the pressured determined in advance by the spring of the selector valve 27, the selector valve 27 is actuated in the rightward direction in the figure to introduce the boom lowering operation pressure b to the pressure compensating valve 7*a* and the selector valve 28. However, since, upon a boom raising operation, the boom lowering operation pressure b is equal to the reservoir pressure, the selector valve 28 is actuated in the rightward direction in the figure to connect the load pressure detection hydraulic line of the flow control valve 6*a* to the pressure compensating valve 7*a* and the shuttle valve 9*a*.

On the other hand, when the front work implement 104 is grounded and the pressure of the bottom side hydraulic line 41*a* of the boom cylinder 3*a* is lower than the pressure determined in advance by the spring of the selector valve 27, the selector valve 27 is actuated in the leftward direction in the figure by the spring thereof to introduce the reservoir pressure to the pressure compensating valve 7*a* and the selector valve 28, whereupon the selector valve 28 is actuated in the rightward direction in the figure by the spring thereof to connect the load pressure detection hydraulic line of the flow control valve 6*a* to the pressure compensating valve 7*a* and the shuttle valve 9*a*.

Meanwhile, upon an arm crowding operation of the arm cylinder 3*b*, the pressure of the bottom side hydraulic line of the arm cylinder 3*b* is introduced to the pressure compensating valve 7*b* and the shuttle valve 9*b* through the load pressure detection hydraulic line of the flow control valve 6*a*.

In this manner, irrespective of whether the front work implement 104 is grounded or not, when boom raising and arm crowding are operated simultaneously, the load pressure of the boom cylinder 3*a* is introduced to the shuttle valve 9*a* through the flow control valve 6*a* and the selector valve 28 and the load pressure of the arm cylinder 3*b* is introduced to the shuttle valve 9*b* through the flow control valve 6*b*. Consequently, the pressure that is higher one of the load pressures is introduced as a maximum load pressure Pl max to the differential pressure reducing valve 11 and the unloading valve 15 by the shuttle valves 9*a* and 9*b*.

By the maximum load pressure Pl max introduced to the unloading valve 15, the spring 15*a* of the unloading valve 15 and the target LS differential pressure Pgr, the set pressure of the unloading valve 15 rises to a value that is the value obtained by adding the target LS differential pressure Pgr and the spring force to the maximum load pressure Pl max, whereupon the hydraulic line for discharging hydraulic fluid of the hydraulic fluid supply line 5 to the reservoir is interrupted.

Further, although the differential pressure reducing valve 11 outputs P1−Pl max as the LS differential pressure Pls depending upon the maximum load pressure Pl max introduced to the differential pressure reducing valve 11, at the moment of activation of the boom in the raising direction or at the moment of activation of the arm in the crowding direction, the pressure P1 of the hydraulic fluid supply line 5 is kept at a low pressure determined in advance by the spring 15*a* of the unloading valve 15 and the target LS differential pressure Pgr, and therefore, the LS differential pressure Pls is substantially equal to the reservoir pressure.

The LS differential pressure Pls is introduced to the LS valve 12*b* in the regulator 12 of the main pump 2.

Since, upon activation of boom raising or arm crowding, Pls=the reservoir pressure<Pgr is satisfied as described above, the LS valve 12*b* is actuated in the leftward direction in the figure, and the hydraulic fluid of the regulator 12 is discharged to the reservoir through the LS valve 12*b*.

Therefore, the flow rate of the main pump 2 gradually increases, and also the LS differential pressure (pump pressure−maximum load pressure) gradually increases.

At this time, when the total requested flow rate of the flow control valve 6*a* for controlling the boom cylinder 3*a* and the flow control valve 6*b* for controlling the arm cylinder 3*b* is higher than the delivery flow rate of the main pump 2, a state called saturation is entered in which the pressure P1 of the main pump 2 does not reach the value obtained by adding the target LS differential pressure Pgr to the maximum load pressure Pl max (the LS differential pressure Pls (=P1−Plax) does not reach the target LS differential pressure Pgr).

In the saturation state, Pls<Pgr is maintained.

On the other hand, when boom raising and arm crowding are operated simultaneously, since the boom lowering operation pressure b is equal to the reservoir pressure, both of the regeneration selector valve 20 and the selector valve 21 are held at the closed position and the selector valve 22 is held at the communication position. Therefore, the hydraulic line 41*c* to which the bottom side hydraulic line 41*a* of the boom cylinder 3*a* and the accumulator 40 is interrupted, and the hydraulic line 41*d* between the hydraulic line 41*c* to which the accumulator 40 is connected and the regeneration selector valve 23 is communicated to introduce hydraulic fluid of the accumulator 40 to the regeneration selector valve 23.

When a saturation state is established by simultaneous operation for boom raising and arm crowding as described above, since Pls<Pgr is maintained, the regeneration selector valve 23 is actuated in the leftward direction in the figure, namely, to the open position, and maintained at the open position.

Since the regeneration selector valve 23 is actuated to the open position, when the pressure of the hydraulic line 41*c* to which the accumulator 40 is connected is higher than the pressure P1 of the hydraulic fluid supply line 5, hydraulic fluid of the accumulator 40 flows into the hydraulic fluid supply line 5 through the selector valve 22, regeneration selector valve 23 and check valve 26 and is regenerated.

Consequently, the hydraulic fluid supplied from the accumulator 40 and the hydraulic fluid delivered from the main pump 2 merge with each other and are supplied to the bottom side of the boom cylinder 3*a* and the bottom side of the arm cylinder 3*b* through the flow control valves 6*a* and 6*b* to drive the boom cylinder 3*a* and the arm cylinder 3*b*. Consequently, speedy boom raising and arm crowding works become possible, and good combined operability can be implemented.

(e) Where a Boom Lowering Operation is Performed from a State in Which the Front Work Implement 104 is Grounded The boom lowering operation pressure b is outputted from the pilot valve of the boom operation device 60*a*. By the boom lowering operation pressure b, the flow control valve 6*a* is actuated in the leftward direction in the figure.

In the state in which the front work implement 104 is grounded, since the pressure of the bottom side hydraulic line 41*a* of the boom cylinder 3*a* is low, the selector valve 27 is actuated in the leftward direction in the figure to introduce the reservoir pressure to the pressure compensating valve 7*a* and the selector valve 28. Consequently, the selector valve 28 is actuated in the rightward direction in the figure to introduce the load pressure of the boom cylinder 3*a* (in the boom lowering operation, the rod pressure of the boom cylinder 3*a*) to the pressure compensating valve 7*a* and the shuttle valve 9*a*.

When a boom lowering operation is performed in the state in which the front work implement 104 is grounded in this manner, the load pressure of the boom cylinder 3*a* (pressure of the rod side hydraulic line 42) is introduced to the pressure compensating valve 7*a* and the shuttle valve 9*a* through the flow control valve 6*a* and the selector valve 28 and is introduced as the maximum load pressure Pl max to the differential pressure reducing valve 11 and the unloading valve 15.

By the maximum load pressure Pl max introduced to the unloading valve 15, the spring 15*a* of the unloading valve 15 and the target LS differential pressure Pgr, the set pressure of the unloading valve 15 rises to a value obtained by adding the target LS differential pressure Pgr and the spring force to the maximum load pressure Pl max of the boom cylinder 3*a* to interrupt the line for discharging the hydraulic fluid of the hydraulic fluid supply line 5 to the reservoir.

Further, although the differential pressure reducing valve 11 outputs P1−Pl max as the LS differential pressure Pls depending upon the maximum load pressure Pl max introduced to the differential pressure reducing valve 11, since, at the moment of activation in the boom lowering direction, the pressure P1 of the hydraulic fluid supply line 5 is kept at a low pressure determined in advance from the spring 15*a* of the unloading valve 15 and the target LS differential pressure Pgr.

The LS differential pressure Pls is introduced to the LS valve 12*b* in the regulator 12 of the variable displacement type main pump 2.

Since, upon activation of boom lowering, Pls=reservoir pressure<Pgr is satisfied as described above, the LS valve 12*b* is actuated in the leftward direction in the figure, and the hydraulic fluid of the flow control piston 12*c* is discharged to the reservoir through the LS valve 12*b*.

Therefore, the flow rate of the main pump 2 gradually increases, and the flow rate increase continues until the LS differential pressure Pls becomes equal to the target LS differential pressure Pgr.

On the other hand, by the boom lowering operation pressure b, the regeneration selector valve 20 and the selector valve 21 are switched to their open position and the selector valve 22 is actuated to the closed position.

As described hereinabove, when a boom lowering operation is performed in the state in which the front work implement 104 is grounded, the pressure of the bottom side hydraulic line 41*a* of the boom cylinder 3*a* becomes a low pressure, and when the pressure is lower than the pressure of the rod side hydraulic line 42 of the boom cylinder 3*a*, even if the regeneration selector valve 20 is actuated to the open position, since the check valve 24 exists, a flow from the bottom side hydraulic line 41*a* to the rod side hydraulic line 42 does not occur.

Further, hydraulic fluid flowing out from the bottom side hydraulic line 41*a* of the boom cylinder 3*a* is discharged to the reservoir through the boom lowering meter out opening of the flow control valve 6*a* and is simultaneously introduced to the accumulator 40 through the check valve 25, when a boom lowering operation is performed in the state in which the front work implement 104 is grounded as described above, since the pressure of the bottom side hydraulic line 41*a* of the boom cylinder 3*a* is a low pressure, when the pressure of the bottom side hydraulic line 41*a* is lower than a minimum working pressure of the accumulator 40 of the bottom side hydraulic line 41*a*, accumulation into the accumulator 40 is not performed.

Advantages

According to the present embodiment, the following advantages are attained.

1. When a boom lowering operation is performed in a state in which the front work implement 104 is not grounded as in the case of (b) described hereinabove, a part of returning fluid from the bottom side of the boom cylinder is regenerated on the rod side to raise the boom cylinder bottom pressure and part of the returned fluid of the increased pressure is accumulated into the accumulator and the pressure compensating valve for controlling the boom cylinder is closed such that the pilot primary pressure Ppi0 kept fixed by the pilot relief valve 32 is introduced to the flow control piston 12*c* of the regulator 12. Consequently, the delivery flow rate of the variable displacement type main pump 2 can be suppressed to the minimum to suppress the power consumption.

2. Further, when the LS differential pressure Pls is lower than the target LS differential pressure Pgr by an operation other than a boom lowering operation, namely, when a so-called saturation is established, the regeneration selector valve 23 is actuated to the open position to allow supply from the accumulator 40 to the hydraulic fluid supply line 5 of the variable displacement type main pump 2. Therefore, the hydraulic fluid accumulated in the accumulator 40 by a boom lower motion is supplied to the hydraulic fluid supply line 5 and regenerated and then merges with and is supplied together with hydraulic fluid delivered from the main pump 2 to the actuators such as the boom cylinder 3*a* and the arm cylinder 3*b* and so forth to drive the actuators. Consequently, speedy boom raising and arm crowding works become possible, and good combined operability can be implemented.

3. On the other hand, when the LS differential pressure Pls is equal to or higher than the target LS differential pressure Pgr by an operation other than a boom lowering operation as in the case (c) described above, namely, when the hydraulic fluid delivered from the main pump 2 is sufficient with respect to the requested flow rate of the flow control valve, the regeneration selector valve 23 is actuated to the closed position to inhibit regeneration from the accumulator 40 to the hydraulic fluid supply line 5 of the main pump 2. Therefore, it can be prevented that the hydraulic fluid accumulated in the accumulator 40 is discharged uselessly from the unloading valve 15 connected to the hydraulic fluid supply line 5 of the main pump 2 (consumed uselessly by the unloading valve 15).

It is to be noted that, while the regeneration selector valve 23 in the embodiment described above is configured such that, when the LS differential pressure Pls is higher than the target LS differential pressure Pgr (Pls>Pgr), it fully closes to cut off the hydraulic line 41*d* and the regeneration hydraulic line 41*e* to inhibit supply of hydraulic fluid from the accumulator 40 to the hydraulic fluid supply line 5 of the main pump 2, the regeneration selector valve 23 may otherwise be configured such that it is not closed fully but is actuated to a throttling position to suppress supply of hydraulic fluid from the accumulator 40 to the hydraulic fluid supply line 5 of the main pump 2 (to permit somewhat flow of hydraulic fluid). Even with this configuration, when the LS differential pressure Pls is equal to or higher than the target LS differential pressure Pgr by any other operation than a boom lowering operation as in the case (c) described hereinabove, regeneration from the accumulator 40 to the hydraulic fluid supply line 5 of the main pump 2 is restricted, and therefore, it can be prevented that the hydraulic fluid accumulated in the accumulator 40 is discharged uselessly from the unloading valve 15. Further, in this case, the increasing rate of the regeneration flow rate in the hydraulic fluid supply line 5 is moderated, and the speed of the actuator can be increased smoothly.

Further, while the regeneration selector valve 23 in the present embodiment is a hydraulic selector valve, the regeneration selector valve 23 may be configured otherwise from a solenoid selector valve and the LS differential pressure Pls and the target LS differential pressure Pgr may be decided in magnitude by a controller such that the solenoid selector valve is switched in response to a result of the decision.

Second Embodiment

A hydraulic drive system for a work machine according to a second embodiment of the present invention is described principally in regard to differences thereof from that of the first embodiment with reference to FIGS. 4 to 7C.

Configuration

Figure 4:
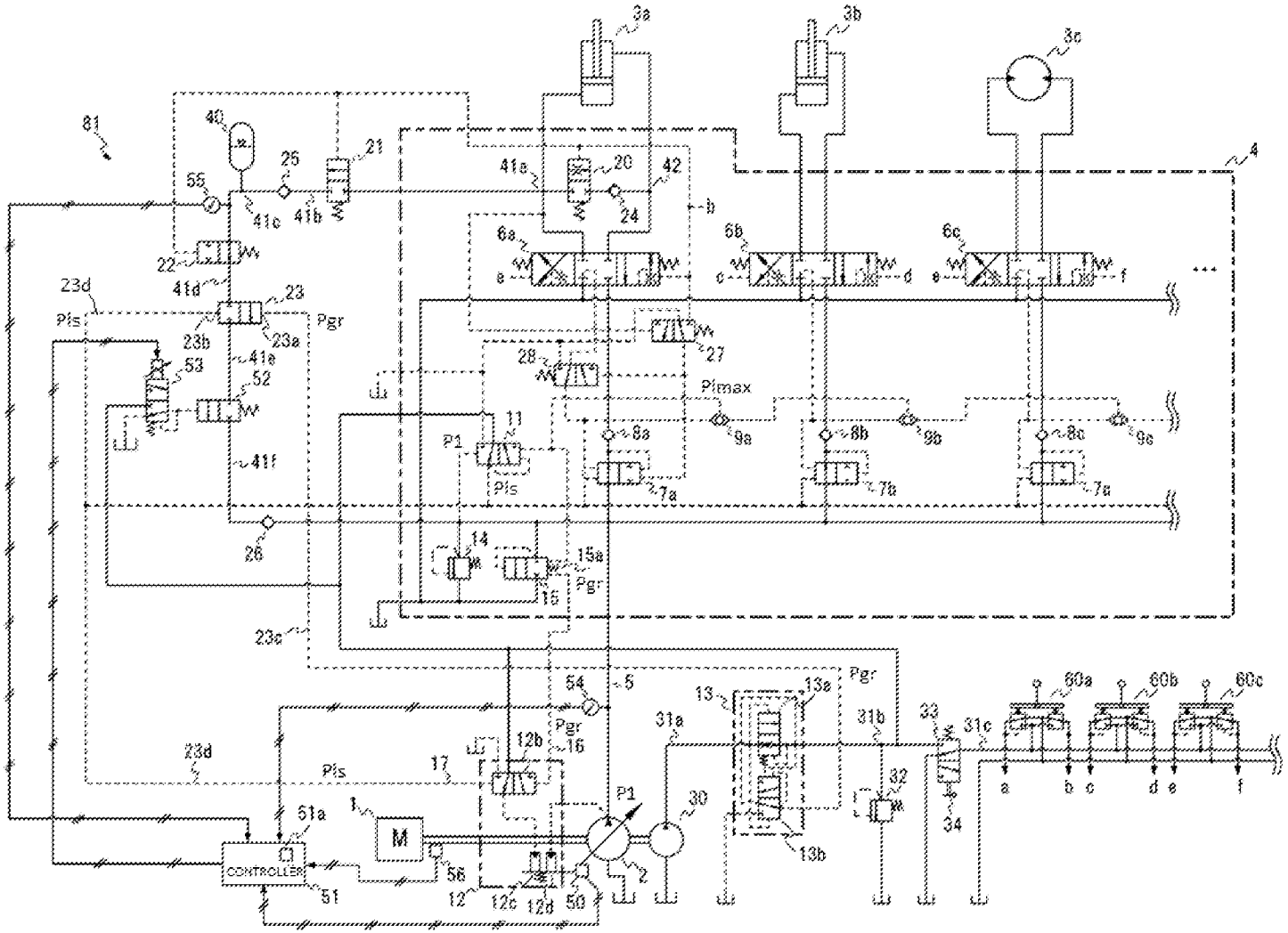
FIG. 4 is a view depicting a configuration of a hydraulic drive system for a work machine according to a second embodiment of the present invention.

FIG. 4 is a view depicting a configuration of the hydraulic drive system for a work machine according to the second embodiment of the present invention.

Referring to FIG. 4, the hydraulic drive system of the present invention includes a hydraulic energy recovery device 81, and this hydraulic energy recovery device 81 includes, in addition to the components of the first embodiment, a tilting angle sensor 50 (first sensor) for detecting the tilting angle of the variable displacement type main pump 2, a rotational speed sensor 56 (second sensor) for detecting the rotational speed of the prime mover 1, a pressure sensor 54 (fourth sensor) for detecting the pressure P1 of the hydraulic fluid supply line 5 of the main pump 2, a pressure sensor 55 (third sensor) for detecting the pressure Pacc of the hydraulic line 41*c* to which the accumulator 40 is connected, a controller 51 that receives the tilting angle sensor 50, rotational speed sensor 56 and pressure sensors 54 and 55 as inputs thereto, performs predetermined arithmetic operation processing and outputting a command current, a solenoid proportional valve 53 driven by the command current outputted from the controller 51 to proportionally control the output pressure, and a regeneration selector valve 52 (second regeneration selector valve) disposed in the regeneration hydraulic lines 41*e* and 41*f*, operable by the output pressure of the solenoid proportional valve 53 and having an adjustable opening area.

Figure 5:
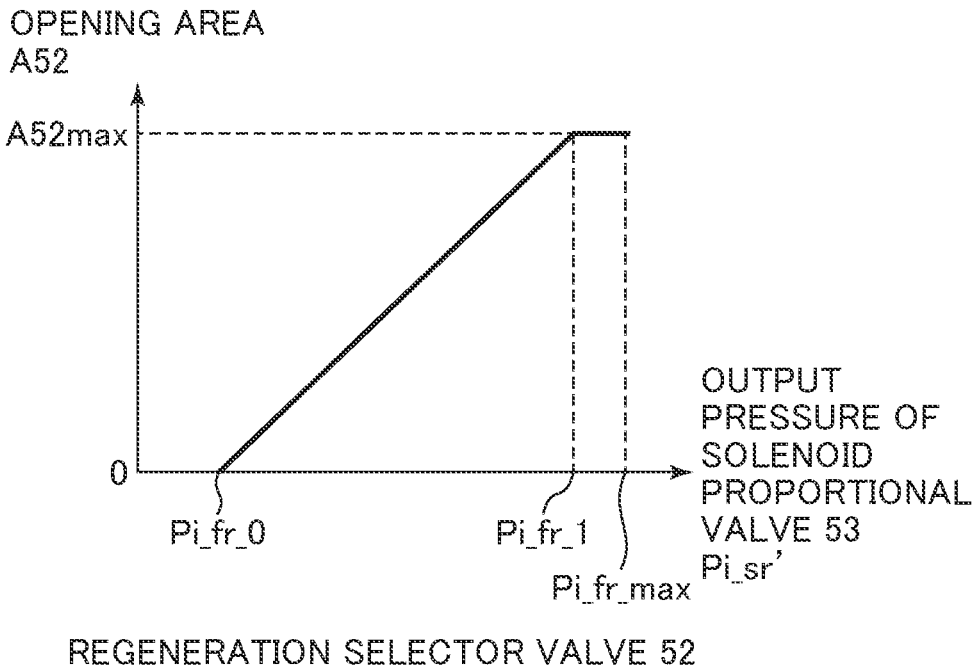
FIG. 5 is a view depicting an opening area characteristic of a regeneration selector valve (second regeneration selector valve) disposed at the downstream side of the first regeneration selector valve.

FIG. 5 is a view depicting an opening area characteristic of the regeneration selector valve 52.

As depicted in FIG. 5, an opening area A52 of the regeneration selector valve 52 is 0 when the output pressure Pi_sr' of the solenoid proportional valve 53 is lower than an effective minimum value Pi_fr_0 and, when the output pressure Pi_sr' becomes higher than the effective minimum value Pi_fr_0, then also the opening area A52 increases, and then the opening area A52 reaches maximum A52*max* at Pi_sr'=Pi_fr_1 and, where Pi_sr'>Pi_fr_1, the opening area A52 is maintained at maximum A52*max*.

Figure 6:
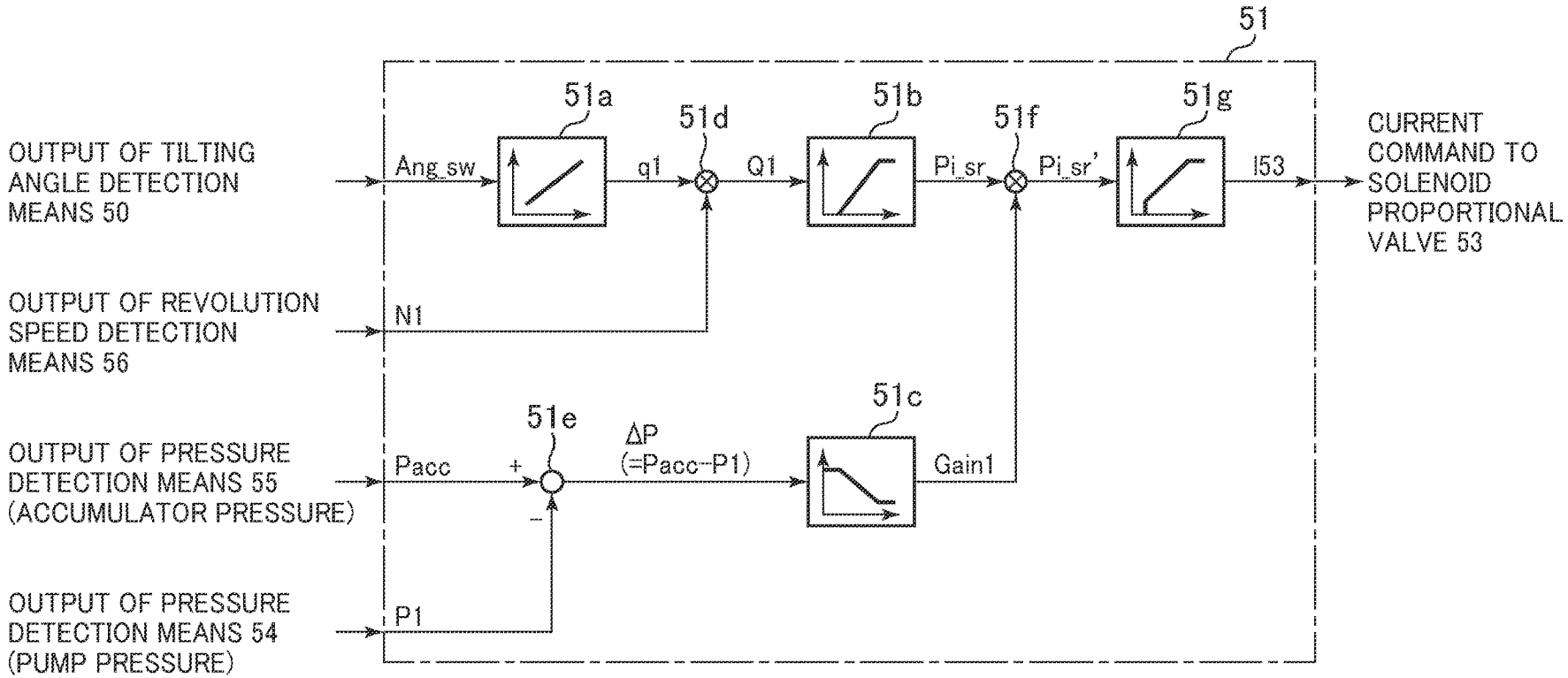
FIG. 6 is a functional block diagram depicting contents of a process to be performed by a CPU of a controller.
Figure 7A:
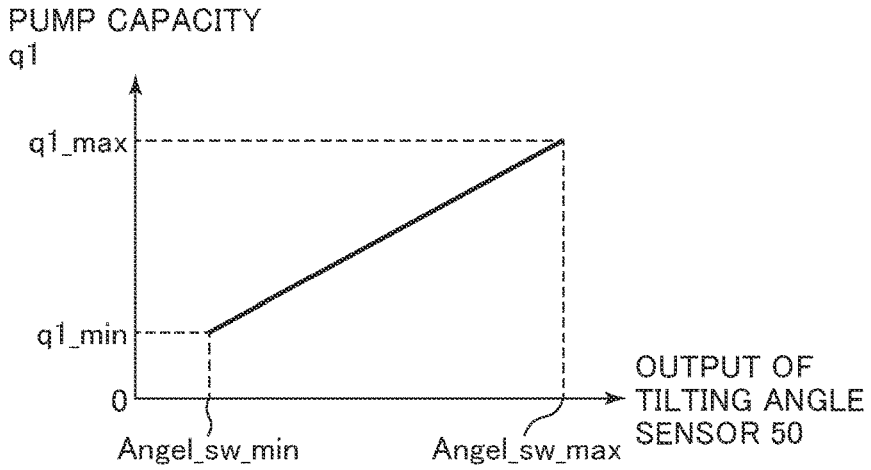
FIG. 7A is a view depicting a characteristic of a first table to be used by the CPU of the controller.
Figure 7B:
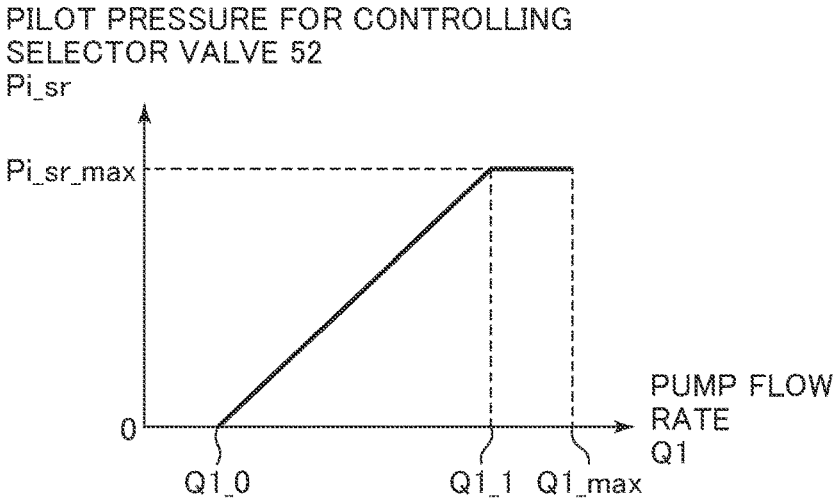
FIG. 7B is a view depicting a characteristic of a second table to be used by the CPU of the controller.
Figure 7C:
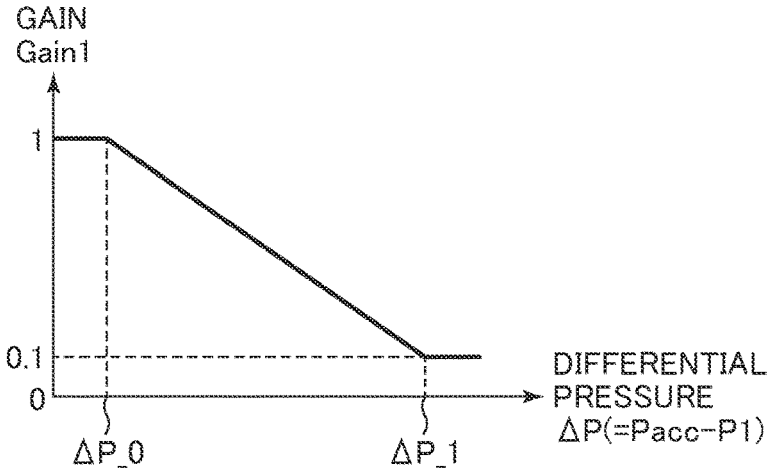
FIG. 7C is a view depicting a characteristic of a third table to be used by the CPU of the controller.

FIG. 6 is a functional block diagram depicting processing contents performed by the CPU 51*a* of the controller 51, and FIGS. 7A, 7B and 7C are views depicting characteristics of first to third tables 51*a*, 51*b* and 51*c* that are used by the CPU 51*a* of the controller 51, respectively.

Referring to FIG. 6, the CPU 51*a* of the controller 51 has processing functions by first to fourth tables 51*a*, 51*b*, 51*c* and 51*g*, a multiplier 51*d*, a differentiator 51*e* and another multiplier 51*f*.

A tilting angle Ang_sw of the variable displacement type main pump 2 inputted from the tilting angle sensor 50 is converted into a displacement q1 of the main pump 2 with the first table 51*a*.

The characteristic of the first table 51*a* is such as depicted in FIG. 7A, and when the tilting angle Ang_sw of the main pump 2 is minimum Angle_sw_min, also the displacement q1 of the main pump 2 is minimum q1_min. Then, as the tilting angle Ang_sw becomes equal to or higher than Angle_sw_min, the displacement q1 increases in response to the increase of the tilting angle Ang_sw, and when the tilting angle Ang_sw reaches maximum Angle_sw_max, also the displacement q1 of the main pump 2 reaches maximum q1_max.

The displacement q1 is multiplied by a rotational speed N1 of the prime mover 1 that is an input from the rotational speed sensor 56 by the multiplier 51*d* and becomes a flow rate Q1.

The flow rate Q1 is converted into a pilot pressure Pi_sr for controlling the regeneration selector valve 52 with the second table 51*b*.

The characteristic of the second table 51*b* is such as depicted in FIG. 7B, and while the delivery flow rate of the main pump 2, namely, the pump flow rate Q1, is lower than a predetermined value Q1_0 proximate to 0, the pilot pressure Pi_sr is 0, and as the pump flow rate Q1 becomes equal to or higher than Q1_0, the pilot pressure Pi_sr increases in accordance with the increase of the pump flow rate Q1. Then, if the pump flow rate Q1 becomes a predetermined value Q1_1 a little lower than a maximum pump flow rate, the pilot pressure Pi_sr reaches the maximum Pi_sr_max. Within the range of Q1>Q1_1, the pilot pressure Pi_sr is kept at the maximum Pi_sr_max.

On the other hand, the pressure of the accumulator 40 inputted from the pressure sensor 55, namely, the accumulator pressure Pacc, and the delivery pressure of the main pump 2 inputted from the pressure sensor 54, namely, the pressure P1, are differentiated by the differentiator 51*e* and a differential pressure ΔP (=Pacc−P1) is obtained. The differential pressure ΔP is converted into a gain Gain1 with the third table 51*c*.

The characteristic of the third table 51*c* is such as depicted in FIG. 7C, and where the differential pressure ΔP is equal to or lower than a predetermined value ΔP_0 proximate to 0, the gain Gain1 is 1, and as the differential pressure ΔP increases, the gain Gain1 gradually decreases. Then, when the differential pressure ΔP becomes a predetermined value ΔP_1, Gain1 reaches its minimum value (in the present embodiment, 0.1), and even if the differential pressure ΔP is increased further, the gain Gain1 is kept at the minimum value.

The pilot pressure Pi_sr that is an output of the second table 51*b* and the gain Gain1 that is an output of the third table 51*c* are multiplied by the multiplier 51*f*, and a command output pressure Pi_sr' is obtained.

The command output pressure Pi_sr' is converted into a current command I53 to the solenoid proportional valve 53 with the fourth table 51*g* and outputted to the solenoid proportional valve 53.

In the foregoing, the regeneration selector valve 52, tilting angle sensor 50, rotational speed sensor 56, pressure sensors 54 and 55, controller 51 and solenoid proportional valve 53 function as a regeneration limitation device that limits supply of hydraulic fluid from the accumulator 40 to the hydraulic fluid supply line 5 of the main pump 2 so as to decrease the supply of hydraulic fluid as the at least one of the delivery flow rate of the main pump 2 and the difference between the pressure of the accumulator 40 and the pressure of the hydraulic fluid supply line 5 of the main pump 2 decreases.

Then, the controller 51 determines a target opening area of the regeneration selector valve 52 (second regeneration selector valve) based on detection values of the tilting angle sensor 50 (first sensor), rotational speed sensor 56 (second sensor) and pressure sensors 54 and 55 (third and fourth sensors) and generates a selection command for the second regeneration selector valve, and the solenoid proportional valve 53 causes the regeneration selector valve 52 to secure the target opening area based on the selection command.

Operation

Operation of the second embodiment is described below.

In boom lowering operation, accumulation of hydraulic fluid into the accumulator 40 and flow rate control of the variable displacement type main pump 2 are similar to those in the first embodiment.

The second embodiment is different from the first embodiment in operation when, in such a case that hydraulic fluid is accumulated in the accumulator 40 and boom raising and arm crowding are operated simultaneously, hydraulic energy accumulated in the accumulator 40 is merged into the hydraulic fluid supply line of the main pump 2 when the main pump 2 is in a saturation state and a state of Pls<Pgr is established.

Since, in the saturation state, Pls<Pgr is established similarly as in the first embodiment, the regeneration selector valve 23 is actuated in the leftward direction in the figure to introduce hydraulic fluid of the accumulator 40 to the regeneration hydraulic line 41*e*.

At this time, when the tilting of the main pump 2 is small and the pump flow rate is lower than Q1_1, for example, is a value in the proximity of Q1_0, the pilot pressure Pi_sr for controlling the regeneration selector valve 52 has a low value proximate to 0 in accordance with the second table 51*b* depicted in FIG. 7B. Therefore, even if the gain Gain1 arithmetically operated in accordance with the third table 51*c* at this time is 1, also the final output pressure Pi_sr' for controlling the regeneration selector valve 52 has a low value proximate to 0.

Therefore, the regeneration selector valve 52 is controlled so as to reduce the opening area thereof, and hydraulic fluid of the accumulator 40 is throttled by the opening of the regeneration selector valve 52 and merges into the hydraulic fluid supply line 5 through the check valve 26.

On the other hand, when the tilting of the main pump 2 is great and the rotational speed of the prime mover 1 is high, namely, when the delivery flow rate Q1 of the main pump 2 is high and the pump flow rate is equal to or higher than Q1_1, the pilot pressure Pi_sr for controlling the regeneration selector valve 52 becomes a maximum value Pi_sr_max in accordance with the second table 51*b* depicted in FIG. 7B.

Here, when the differential pressure ΔP between the accumulator pressure Pacc and the pump pressure P1 is great, for example, when the pump pressure upon simultaneous operation of boom raising and arm crowing and ΔP=Pacc−P1>ΔP_1 is satisfied like such a case that boom lowering operation is just ended and a sufficiently high pressure is accumulated in the accumulator 40 and besides the arm has a posture proximate to a maximum crowding posture and the load pressure of the boom cylinder 3*a* is low or in a like case, the gain Gain1 becomes 0.1 that is a minimum value in accordance with the characteristic of the third table 51*c* depicted in FIG. 7C.

Then, since the final output pressure Pi_sr' for controlling the regeneration selector valve 52 becomes the product when the pilot pressure Pi_sr is multiplied by the gain Gain1, the output pressure Pi_sr' in this case is represented by Pi_sr'=Pi_sr_max×0.1.

In this manner, the opening area of the regeneration selector valve 52 becomes small when the differential pressure ΔP between the accumulator pressure Pacc and the pressure P1 is great, and hydraulic fluid of the accumulator 40 is throttled by the opening of the regeneration selector valve 52 and merges into the hydraulic fluid supply line 5 through the check valve 26.

Further, the hydraulic fluid accumulated in the accumulator 40 is discharged to the hydraulic fluid supply line 5 in such a manner as described above, and the accumulator pressure Pcc gradually decreases. Then, as the value of the differential pressure ΔP between the accumulator pressure Pacc and the pressure P1 decreases, the gain Gain1 of the unloading valve 15 gradually increases from the minimum value 0.1 toward the maximum value 1, and when the differential pressure ΔP becomes equal to or smaller than ΔP_0, the gain Gain1 becomes the maximum value.

When the gain Gain1 is 1, the command pilot pressure Pi_sr' for controlling the regeneration selector valve 52 becomes Pi_sr'=Pi_sr_max×1=Pi_sr_max while the regeneration selector valve 52 remains the output Pi_sr_max of the second table 51*b*. Thus, the hydraulic fluid of the accumulator 40 merges into the hydraulic fluid supply line 5 through the check valve 26 without being throttled by the opening of the regeneration selector valve 52.

In this manner, the regeneration selector valve 52 throttles its opening when the delivery flow rate of the variable displacement type main pump 2 is low or when the differential pressure between the accumulator 40 and the hydraulic fluid supply line 5 is great.

Effect

With the second embodiment of the present invention, the following effects are achieved.

1. Similarly as in the first embodiment, in a boom lowering operation, while part of hydraulic fluid of a raised pressure is accumulated into the accumulator, the delivery flow rate of the variable displacement type main pump 2 can be suppressed to the minimum to suppress the power consumption. Further, in operation other than boom lowering, when a saturation state is established, hydraulic fluid accumulated in the accumulator is merged into the hydraulic fluid supply line of the main pump 2, and this makes a smooth work possible. When a saturation state is not established (when the hydraulic fluid delivered from the main pump 2 is sufficient with respect to a requested flow rate by the flow control valve), regeneration from the accumulator 40 into the hydraulic fluid supply line 5 of the main pump 2 is inhibited. Therefore, it can be prevented that the hydraulic fluid accumulated in the accumulator 40 is consumed uselessly by the unloading valve 15, and the hydraulic fluid accumulated in the accumulator can be used effectively.

2. Further, when the delivery flow rate of the main pump 2 is low or when the differential pressure between the accumulator 40 and the pump pressure is great, the flow rate to be merged from the accumulator 40 into the hydraulic fluid supply line 5 of the main pump 2 is throttled, when, in the saturation state, the delivery hydraulic fluid from the main pump 2 is insufficient with respect to the requested flow rate by the actuators and the speed of each actuator drops, it can be prevented that the speed of the actuators increases suddenly by the flow rate flowing in from the accumulator 40 and the operability is deteriorated.

Others

While, in the description of the embodiments predetermined above, a case is described in which the work machine is a hydraulic excavator that includes a front work implement, an upper swing structure and a lower travel structure, if the work machine includes one or more actuators including a hydraulic cylinder for moving a work device upwardly and downwardly, then it may be a work machine other than a hydraulic excavator such as a wheel loader, a hydraulic crane or a tele handler. Also in this case, similar effects can be achieved.

Further, while the embodiments described above are configured such that the regeneration selector valve 20 is disposed between the bottom side hydraulic line and the rod side hydraulic line of the boom cylinder, the present invention may be applied to a hydraulic drive system that does not include the regeneration selector valve 20.

DESCRIPTION OF REFERENCE CHARACTERS

2 Variable displacement type main pump (hydraulic pump)
3*a* Boom cylinder (hydraulic cylinder)
3*b* Arm cylinder (actuator)
3*c* Swing motor (actuator)
4 Control valve block
5 Hydraulic fluid supply line of main pump 2
6*a* to 6*c* Flow control valve
7*a* to 7*c* Pressure compensating valve
8*a* to 8*c*, 24, 25, 26 Check valve
11 Differential pressure reducing valve
12 Regulator
13 Prime mover rotational speed detection valve
14 Relief valve
15 Unloading valve
20 Regeneration selector valve
21, 22, 27, 28 Selector valve
23 Regeneration selector valve (regeneration selective valve device; first regeneration selector valve)
23*a* Pressure receiving portion (selection controller; first pressure receiving portion)
23*b* Pressure receiving portion (selection controller; second pressure receiving portion)
23*c* Hydraulic line (selection controller; first hydraulic line)
23*d* Hydraulic line (selection controller; second hydraulic line)
30 Fixed displacement type pilot pump
40 Accumulator
41*a* to 41*f*, 42 Hydraulic line
41*e*, 41*f* Regeneration hydraulic line
50 Tilting angle sensor (first sensor)
51 Controller
52 Regeneration selector valve (second regeneration selector valve)
53 Solenoid proportional valve
54, 55 Pressure sensor (third, fourth sensor)
56 Rotational speed sensor (second sensor)
60*a* to 60*c* Plural operation devices
80, 81 Hydraulic energy recovery device
104 Front work implement (work device)
111 Boom

The invention claimed is:

1. A hydraulic drive system for a work machine, comprising:

a prime mover;

a variable displacement hydraulic pump driven by the prime mover;

one or more actuators that are driven by a hydraulic fluid delivered from the hydraulic pump and includes a hydraulic cylinder for moving a work device upwardly and downwardly;

one or more flow control valves that control a flow of hydraulic fluid to be supplied from the hydraulic pump to the one or more actuators;

a regulator that performs load sensing control for controlling a delivery flow rate of the hydraulic pump such that when a difference between a pressure of a hydraulic fluid supply line of the hydraulic pump and a maximum load pressure is greater than a target LS differential pressure dependent on a rotational speed of the prime mover, the delivery flow rate of the hydraulic pump is decreased, and when the difference between the pressure of the hydraulic fluid supply line of the hydraulic pump and the maximum load pressure is smaller than a target LS differential pressure, the delivery flow rate of the hydraulic pump is increased;

an unloading valve that opens and returns a hydraulic fluid of the hydraulic fluid supply line of the hydraulic pump to a reservoir when the pressure of the hydraulic fluid supply line becomes equal to or higher by a predetermined value than the maximum load pressure of the one or more actuators, the predetermined value being equal to or larger than the target LS differential pressure; and a hydraulic energy recovery device that includes an accumulator connected to the hydraulic cylinder and the hydraulic fluid supply line of the hydraulic pump and accumulates a hydraulic fluid returned from the hydraulic cylinder into the accumulator when an operation of lowering the work device is performed, and supplies and regenerates at least a part of the hydraulic fluid accumulated in the accumulator to the hydraulic fluid supply line of the hydraulic pump when an operation other than the operation of lowering the work device is performed;

wherein the hydraulic energy recovery device includes a regeneration selector valve device that controls a regeneration flow rate of a hydraulic fluid to be supplied from the accumulator to the hydraulic fluid supply line of the hydraulic pump; and the regeneration selector valve device is configured to control a communication between the accumulator and the hydraulic fluid supply line of the hydraulic pump such that, when the difference between the pressure of the hydraulic fluid supply line of the hydraulic pump and the maximum load pressure is greater than the target LS differential pressure, supply of the hydraulic fluid from the accumulator to the hydraulic fluid supply line of the hydraulic pump is limited, and when the difference between the pressure of the hydraulic fluid supply line of the hydraulic pump and the maximum load pressure is smaller than the target LS differential pressure, supply of the hydraulic fluid from the accumulator to the hydraulic fluid supply line of the hydraulic pump is permitted.

2. The hydraulic drive system for a work machine according to claim 1, wherein the regeneration selector valve device includes:

a first regeneration selector valve disposed in a regeneration hydraulic line for supplying a hydraulic fluid from the accumulator to the hydraulic fluid supply line of the hydraulic pump; and a selection control device configured to actuate the first regeneration selector valve to a position to interrupt the regeneration hydraulic line when the difference between the pressure of the hydraulic fluid supply line of the hydraulic pump and the maximum load pressure is greater than the target LS differential pressure, and actuate the first regeneration selector valve to a position to communicate the regeneration hydraulic line when the difference between the pressure of the hydraulic fluid supply line of the hydraulic pump and the maximum load pressure is smaller than the target LS differential pressure.

3. The hydraulic drive system for a work machine according to claim 2, wherein the selection control device includes a first pressure receiving portion provided at one end of the first regeneration selector valve to act in a valve opening direction, a second pressure receiving portion provided at the other end of the first regeneration selector valve to act in a valve closing direction, a first hydraulic line that introduces the target LS differential pressure to the first pressure receiving portion and a second hydraulic line that introduces a pressure of the difference between the pressure of the hydraulic fluid supply line of the hydraulic pump and the maximum load pressure to the second pressure receiving portion.

4. The hydraulic drive system for a work machine according to claim 1, further comprising:

a regeneration limitation device that limits supply of the hydraulic fluid from the accumulator to the hydraulic fluid supply line of the hydraulic pump so as to decrease the supply of the hydraulic fluid as at least one of the delivery flow rate of the hydraulic pump and a difference between a pressure of the accumulator and a pressure of the hydraulic fluid supply line of the hydraulic pump decreases.

5. The hydraulic drive system for a work machine according to claim 4, wherein the regeneration limitation device includes:

a second regeneration selector valve disposed in a regeneration hydraulic line for supplying the hydraulic fluid from the accumulator to the hydraulic fluid supply line of the hydraulic pump;

a first sensor that detects a displacement of the hydraulic pump;

a second sensor that detects a rotational speed of the hydraulic pump;

a third sensor that detects the pressure of the accumulator;

a fourth sensor that detects the delivery pressure of the hydraulic pump;

a controller configured to determine a target opening area of the second regeneration selector valve based on detection values of the first to fourth sensors and generate a selection common for the second regeneration selector valve; and a solenoid proportional valve that causes the second regeneration selector valve to operate so as to secure the target opening area based on the selection command.

6. The hydraulic drive system for a work machine according to claim 1, wherein the work machine is a hydraulic excavator;

the work device is a front work implement of the hydraulic excavator; and the hydraulic cylinder for moving the work device upwardly and downwardly is a boom cylinder for moving a boom of the front work implement upwardly and downwardly.

* * * * *